US007170466B2

(12) United States Patent
Janoschka

(10) Patent No.: US 7,170,466 B2
(45) Date of Patent: Jan. 30, 2007

(54) WIPER-TYPE PHASE SHIFTER WITH CANTILEVER SHOE AND DUAL-POLARIZATION ANTENNA WITH COMMONLY DRIVEN PHASE SHIFTERS

(75) Inventor: Darin M. Janoschka, Roswell, GA (US)

(73) Assignee: EMS Technologies, Inc., Norcross, GA (US)

( * ) Notice: Subject to any disclaimer, the term of this patent is extended or adjusted under 35 U.S.C. 154(b) by 105 days.

(21) Appl. No.: 10/652,657

(22) Filed: Aug. 28, 2003

(65) Prior Publication Data

US 2005/0046514 A1 Mar. 3, 2005

(51) Int. Cl.
*H01Q 3/02* (2006.01)

(52) U.S. Cl. ..... 343/882; 343/805; 333/156

(58) Field of Classification Search ..... 343/757, 343/767, 770, 872, 876, 763, 805, 882; 333/156, 333/159, 161; 342/371, 374
See application file for complete search history.

(56) References Cited

U.S. PATENT DOCUMENTS

| | | | | |
|---|---|---|---|---|
| 5,917,455 | A | 6/1999 | Huynh et al. | 343/757 |
| 6,005,522 | A | 12/1999 | Arias et al. | 343/770 |
| 6,388,631 | B1 * | 5/2002 | Livingston et al. | 343/767 |
| 6,788,165 | B2 * | 9/2004 | Runyon | 333/117 |
| 6,864,837 | B2 * | 3/2005 | Runyon et al. | 342/372 |
| 2003/0076198 | A1 * | 4/2003 | Phillips et al. | 333/161 |

FOREIGN PATENT DOCUMENTS

| | | |
|---|---|---|
| JP | 58-075901 | 5/1983 |
| JP | 06-326501 | 11/1994 |
| JP | 10-013103 | 1/1998 |

* cited by examiner

*Primary Examiner*—Tuyet Vo
*Assistant Examiner*—Jimmy Vu
(74) *Attorney, Agent, or Firm*—Mehrman Law Office, P.C.; Michael J. Mehrman

(57) ABSTRACT

A wiper-type phase shifter with a cantilever shoe that ensures that the electrical contact on the wiper arm remains in electrical communication with the transmission trace located on the antenna backplane without relying to an element, such as a spring-loaded set screw, that passes through the backplane. The cantilever shoe thus provides a wiper hold-down mechanism without requiring holes or slots through the backplane, which could allow rain or other elements to get inside the antenna enclosure. A dual-polarization antenna that includes a wiper-type phase shifter for each polarization. The wiper arms define gear portions that engage each other, which allows a single actuator, typically located on the rear of the backplane opposite the location of the wiper arms, to drive both wiper arms in a coordinated manner. The antenna is suitable for use as a wireless base station antenna.

20 Claims, 17 Drawing Sheets

WIPER-TYPE PHASE SHIFTER WITH CANTILEVER SHOE AND DUAL-POLARIZATION ANTENNA WITH COMMONLY DRIVEN PHASE SHIFTERS

REFERENCE TO RELATED APPLICATIONS

This application incorporates by reference the disclosures of commonly owned U.S. patent application Ser. No. 10/290,838 entitled "Variable Power Divider" filed on Nov. 8, 2002; U.S. patent application Ser. No. 10/226,641 entitled "Microstrip Phase Shifter" filed on Aug. 23, 2002; U.S. patent application Ser. No. 10/623,379 entitled "Vertical Electrical Downtilt Antenna" filed on Jul. 18, 2003; and U.S. patent application Ser. No. 10/623,382 entitled "Double-Sided, Edge-Mounted Stripline Signal Processing Modules And Modular Network" filed on Jul. 18, 2003.

TECHNICAL FIELD

The present invention relates to wireless base station antennas systems and, more particularly, relates to a wiper-type phase shifter with a cantilever shoe and a dual-polarization antenna including commonly driven phase shifters.

BACKGROUND OF THE INVENTION

The present invention represents an improvement over the phase shifters described in commonly owned U.S. patent application Ser. No. 10/290,838 entitled "Variable Power Divider" filed on Nov. 8, 2002 and U.S. patent application Ser. No. 10/226,641 entitle "Microstrip Phase Shifter" filed on Aug. 23, 2002, which are incorporated herein by reference. The relevant background technology described in those applications will not be repeated here. In addition, the phase shifter described in this specification may be deployed in the dual-polarization antenna described in commonly owned U.S. patent application Ser. No. 10/623,379 entitled "Vertical Electrical Downtilt Antenna" filed on Jul. 18, 2003, which is also incorporated herein by reference. Again, the background technology relevant to this embodiment of the invention is described in that application and will not be repeated here.

Generally, the market for wireless base station antennas is highly price and performance competitive. Therefore, there is an on-going need for cost effective techniques for providing the technical features desired for these antennas. For example, advancements that reduce the size, cost, complexity, or number of moving parts are generally desirable. Of course, accurate and repeatable performance, as well ruggedness, longevity and low maintenance costs are also desirable. Meeting these competing design objectives is particularly challenging with respect to the moving parts of the antenna, such as the phase shifters used for beam steering and in variable power dividers, which may also be used for beam steering.

In particular, conventional phase shifters have used a wiper arm that slides along a transmission media trace located on a backplane to implement a differential phase shifter. See, for example, Japanese publication number 06-326501, published 25 Nov. 1994, naming Mita Masaki and Tako Noriyuki as inventors. This type of phase shifter can experience failure if the wiper arm loses electrical communication with the transmission media trace. Because wireless base station antennas are typically deployed outdoors on buildings or towers, they are subject to the variable stresses and dimensional changes induced by temperature changes, vibration and external forces of wind, and other types of environmental conditions and variations over extended periods of time. These conditions can cause relative dimensional changes to occur between the components of the phase shifter assembly that can result in changes in the degree of wiper contact with the transmission media trace. Changes in wiper contact, such as partial wiper arm separation, can result in operational performance changes of the antenna. In extreme cases, complete wiper arm separation can result in operational failure of the antenna.

One conventional approach to solving the wiper arm separation problem is shown in FIG. 1. This configuration includes a slot 1 through the backplane 2 adjacent to the transmission media trace 5 and a spring-loaded set screw 3 extending from the wiper arm 4 through the slot. This approach is very effective at maintaining electrical communication between the wiper arm 4 and the transmission media trace 5, but has the disadvantage of requiring a slot through the backplane 2. This is a problem because in a typically wireless base station antenna, the backplane serves as an exterior wall intended to keep out the weather elements. Cutting slots through the backplane can cause water to enter the antenna, which can cause the antenna to short, corrode, and freeze if the temperature drops. To solve this problem, the phase shifter shown in FIG. 1 does not use the backplane 2 as an exterior enclosure wall, but instead houses the backplane in an enclosure 6 that includes a separate exterior wall 7. Providing this exterior wall in addition to backplane 2, as well as brackets for supporting the backplane within the enclosure 6, increases the cost and complexity of the antenna.

In addition, dual-polarization antennas typically include a duplication of actuator, transmission and radiating elements; one for each polarization. Outfitting dual-polarization antennas with beam steering phase shifters in the conventional manner likewise requires a duplication of the phase shifters and associated actuators. This type of duplication can be costly, particularly when the phase shifters are motor driven, which is desirable for remotely controlled operation. It is often desired to vary the phase in a like manner for each polarization to achieve corresponding characteristics. For this reason, commonly operating the phase shifters in a coordinated manner advantageously eliminates duplicate components.

Accordingly, there is an ongoing need for more cost effective systems for implementing phase shifters for wireless base station antennas including dual-polarization antennas. There is a further need for phase shifters for dual-polarization antennas that eliminate the duplication of parts.

SUMMARY OF THE INVENTION

The present invention meets the needs described above in an antenna suitable for use as a wireless base station antenna that includes a wiper-type phase shifter with a cantilever shoe that ensures that the electrical contact on the wiper arm remains in electrical communication with the transmission trace located on the antenna backplane without relying to an element, such as a spring-loaded set screw, that passes through the backplane. The cantilever shoe thus provides a wiper hold-down mechanism without requiring holes or slots through the backplane, which could allow rain or other elements to get inside the antenna enclosure. The cantilever shoe is also a small, light weight, low maintenance, and inexpensive wiper arm hold-down mechanism in comparison to larger, bulkier, more complex, and more expensive hold-down mechanism employed previously. In addition, locating a motor for driving the wiper arm on the rear of the backplane opposite the location of the wiper arm advantageously avoids complicated linkage elements.

The invention may also be embodied in a dual-polarization antenna that includes a wiper-type phase shifter for each polarization. The wiper arms define gear portions that engage each other, which allow a single actuator, typically located on the rear of the backplane opposite the location of the wiper arms, to drive both wiper arms in a coordinated manner. Each wiper arm of the dual-polarization antenna may also include a cantilever shoe to gain the benefit of this design, as described above.

Generally described, the invention may be realized in a phase shifter suitable for use in an antenna, such as a wireless base station antenna, that includes a backplane carrying a transmission media trace, such as a two-conductor stripline media commonly known as a microstrip trace. The phase shifter also includes a wiper arm pivotally attached to the backplane and carrying a trace contact. An actuator pivots the wiper arm with respect to the backplane, and a signal conductor is in electrical communication with the trace contact. The phase shifter also includes a cantilever shoe including a trace contact biasing element configured to bias the trace contact toward the transmission media trace to ensure that the trace contact located on the wiper arm remains in electrical communication with the transmission media trace located on the backplane. The trace contact biasing element typically includes a spring-loaded plunger positioned adjacent to the trace contact.

In this manner, the cantilever shoe ensures that the trace contact remains in electrical communication with the transmission media trace without relying on an element that passes through the backplane, such as a spring-loaded set screw. The signal conductor of the phase shifter may also include a signal trace carried on the backplane, and the wiper arm may include a signal contact electrically located between the signal conductor and the trace contact. For this configuration, the cantilever shoe also includes a signal contact biasing element configured to bias the signal contact toward the signal trace. For example, the signal contact biasing element may include a spring washer positioned adjacent to the signal contact.

Electrical communication between the transmission media on the backplane and the trace contact wiper arm can be direct, such that a direct current (DC) can flow between the elements. Alternatively, this connection may be capacitively coupled, such that only a varying signal can flow between the elements. In particular, a capacitive insulating layer, such as a low-loss dielectric sheet, can be located between these electrical conductors to prevent the flow of DC signals. This type of insulating layer advantageously suppresses intermodulation signal products that can occur when the conductors are in direct contact with each other. Without this type of insulating layer, a measurable non-linear current-voltage relationship can develop over time due to corrosion and other environmental conditions.

The phase shifter may be operated manually or mechanically (or both), and it may be controlled locally or remotely (or both). Therefore, the actuator may include a knob for manually pivoting the wiper arm. Alternatively or additionally, the actuator may include a motor for mechanically pivoting the wiper arm. The phase shifter may also include a controller for remotely controlling the motor. Typically, the wiper arm is located on a front side of the backplane and the motor is located on the rear side of the backplane, preferably opposite the location of the wiper arm to minimize the complexity of the linkage between the actuator and wiper arm. The front side may also include radiating elements of an antenna array. The wiper arm may also define a gear section for mechanically linking the wiper to another component, such as a drive gear or another wiper arm. In particular, an antenna may include two phase shifters that each include wiper arms that engage each other in this manner to cause coordinated pivotal movement of the wiper arms. For example, each phase shifter may drive a circuit associated with a polarization of a dual-polarization antenna array.

The invention may also be deployed as an antenna system that includes an array of antenna elements and a wiper-type phase shifter with a cantilever shoe, as described above. The antenna system may also include a beam forming network in electrical communication with the phase shifter and producing a plurality of beam driving signals, and a signal distribution network delivering each beam driving signal to one or more associated antenna elements. In this configuration, the beam driving signals drive the antenna elements to form a beam exhibiting a direction that varies in response to pivotal movement of the wiper arm. In a particular embodiment, the phase shifter drives a variable power divider electrically located between the phase shifter and the beam forming network to produce complimentary amplitude voltage drive signals over a range of voltage amplitude division.

In addition, each antenna element may be a dual-polarization antenna element, and the antenna system may include a similar phase shifter, beam forming network, and signal distribution network for each polarization. In this case, each wiper arm may define a gear section, which is typically cut directly into a dielectric substrate of a printed circuit (PC) board of the wiper arm. The gear sections of the wiper arms for each polarization typically engage each other to cause coordinated pivotal movement of the wiper arms. The antenna system may also include a motor for mechanically pivoting the wiper arms and a controller for remotely controlling the motor. For example, the wiper arms may be located on a front side of the backplane and the motor may be located on the rear side of the backplane, typically opposite to the location of the wiper arms.

Therefore, it will be understood that the invention may also be deployed as a dual-polarization antenna including a phase shifter for each polarization, in which each phase shifter includes a wiper arm in sliding electrical communication with an associated microstrip trace. In this configuration, the wiper arms define gear portions engaging each other and causing the wiper arms to move in a coordinated manner. As noted above, the wiper arms are typically located on a front side of a backplane carrying the microstrip trace, and a motor for mechanically pivoting the wiper arms is typically located on the rear side of the backplane. In addition, the phase shifter for each polarization may include a cantilever shoe for each wiper arm biasing the wiper arm toward its associate microstrip trace.

In view of the foregoing, it will be appreciated that the present invention avoids the drawbacks of prior wiper-type phase shifters and dual-polarization antennas including wiper-type phase shifters. The specific techniques and structures for implementing wiper-type phase shifters with cantilever shoes and dual-polarization antennas with mechanically linked wiper arms, and thereby accomplishing the advantages described above, will become apparent from the following detailed description of the embodiments and the appended drawings and claims.

DETAILED DESCRIPTION OF THE EMBODIMENTS

Figure 1:
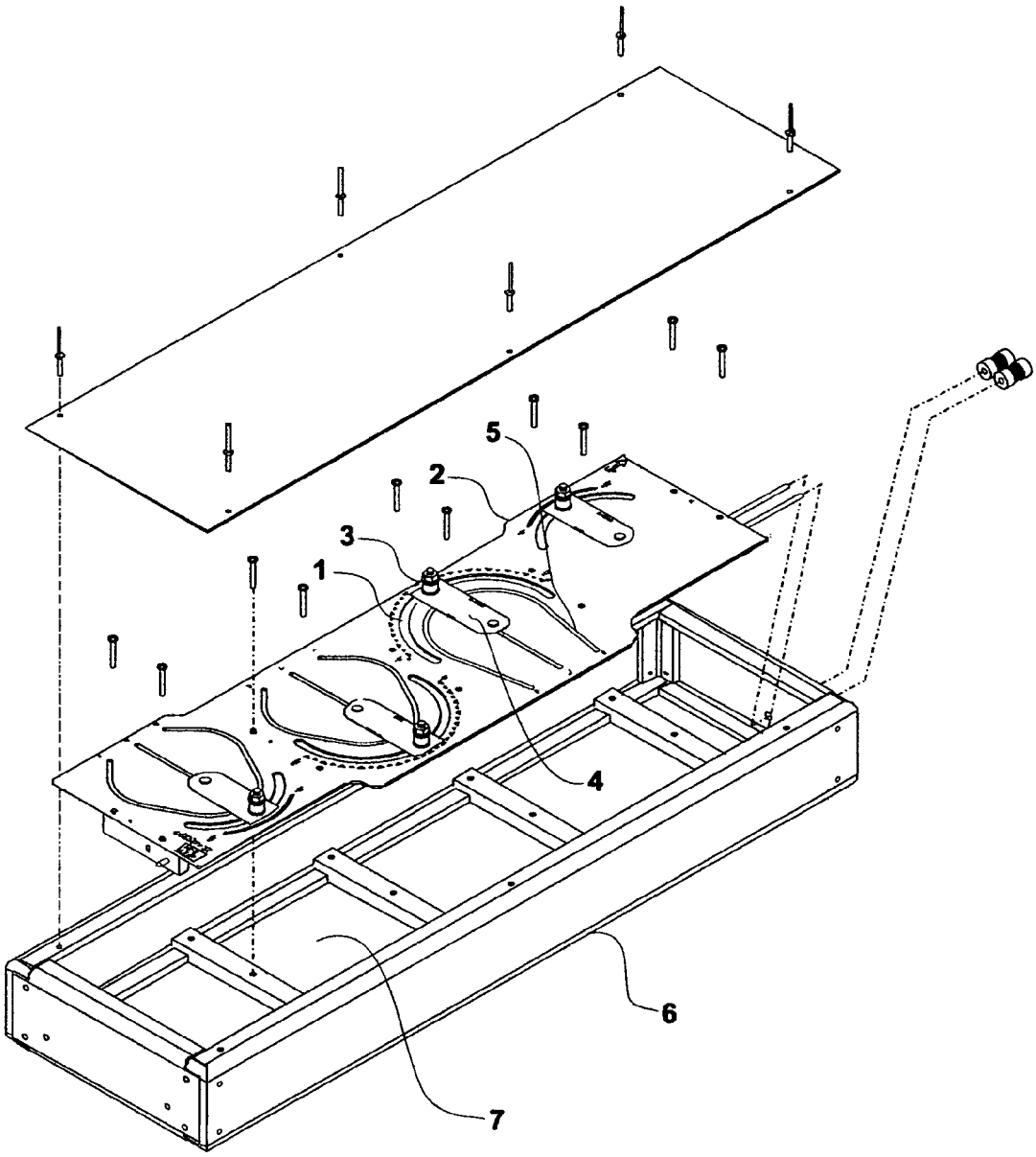
FIG. 1 (PRIOR ART)
FIG. 1 is a an exploded perspective view of a conventional wiper-type phase shifter including a wiper arm hold-down mechanism relying on a spring-loaded set screw that passes through a slot in the phase shifter backplane.

The present invention may be embodied in a wiper-type phase shifter for an antenna, such as a wireless base station antenna, that includes a cantilever shoe wiper arm hold-down mechanism. In particular, this type of phase shifter may be used to drive a beam steering circuit that controls the direction of a beam formed by the antenna, as in a vertical electrical downtilt antenna. However, the phase shifter may also be used to control beam steering in azimuth or any other desired direction. In addition, the phase shifter may also be used to drive systems other than beam forming and beam steering circuits, such as power dividers, analog amplifiers, beam shaping circuits, and any other circuit employing an analog phase shifter.

The present invention may also be embodied in a dual-polarization antenna including commonly-driven wiper-type phase shifters. In particular, the wiper arms of the dual-polarization antenna are mechanically linked to each other through gear faces cut directly into the printed circuit (PC) board substrate of the wiper arm. This allows a common motor to actuate both wiper arms in a coordinated manner, which is desirable for beam steering such as vertical electrical downtilt, in which a coordinated phase shift is applied to different sets of antenna elements. It should be appreciated that this same technique may be used to coordinate other types of wiper arms, such as those controlling different antenna sub-arrays, different beam shaping circuits, and so forth. Similarly, it will be appreciated that the wiper-type phase shifter could also be deployed in a single polarization antenna, and may also be used to coordinate phase shifters or other actuators used for other purposes.

Cutting the gear faces directly into the PC board substrate eliminates the need for a separate component having gear faces, and the need to mechanically couple this separate geared component to the wiper arm. The dual functionality of a wiper arm with integrated geared faces simplifies the mechanical assembly necessary to commonly drive wiper-type phase shifters and reduces the number of discrete components in the dual phase shifter assembly. This advantageously reduces the size, complexity, and cost of the wiper-arm assembly.

The specific wiper-type phase shifter described below is constructed using microstrip RF circuits deployed on dielectric PC boards. Although microstrip RF circuitry is desirable to accomplish a number of design objectives, it should be understood that portions of the antenna circuitry could be implemented using other types of RF conductors, such as coaxial cable, waveguide, air microstrip, or tri-plate stripline. In fact, certain components of a particular commercial dual-polarization antenna (e.g., phase shifter, variable power divider, power distribution network, and antenna elements) are constructed using microstrip while other components (e.g., beam forming network) are constructed using tri-plate stripline. Similarly, coaxial, air microstrip, and other typed of RF links may be deployed as desired.

It should also be understood that the specific biasing elements employed in the cantilever shoe wiper arm hold-down mechanism include a spring-loaded plunger and a wave-shaped spring washer. However, other types of suitable biasing elements may alternatively be employed, such as leaf springs, curved wiper arms, compressible materials, and the like. At the same time, it should also be appreciated that the drag imposed by the biasing elements on the wiper arm and the coefficient of friction of the contacting surfaces dictates, in large measure, the power rating of a motorized actuator. Accordingly, low-friction surfaces and a biasing element providing sufficient and not excessive force is preferred. In addition, biasing elements that facilitate smooth, non-binding wiper arm movement are also preferred. For these reasons, the spring-loaded ball-bearing plunger and spring washer biasing elements are specified for the embodiments described below.

Turning now to the figures, in which like numerals refer to similar elements throughout the several figures, FIG. 1 is a an exploded perspective view of a prior art wiper-type phase shifter including a wiper arm hold-down mechanism relying on a spring-loaded set screw that passes through a slot in the phase shifter backplane. As described previously, this particular phase shifter includes wiper arm hold-down mechanism that relies on a spring-loaded set screw 3 extending from the wiper arm 4 through a slot 1 in the backplane 2. Cutting slots through the backplane makes the backplane unsuitable as an exterior enclosure wall. Therefore, the backplane is mounted within an enclosure 6 that includes a separate exterior wall 7. Providing this exterior wall in addition to backplane 2, as well as brackets for supporting the backplane within the enclosure 6, increases the cost and complexity of the antenna.

Figure 2:
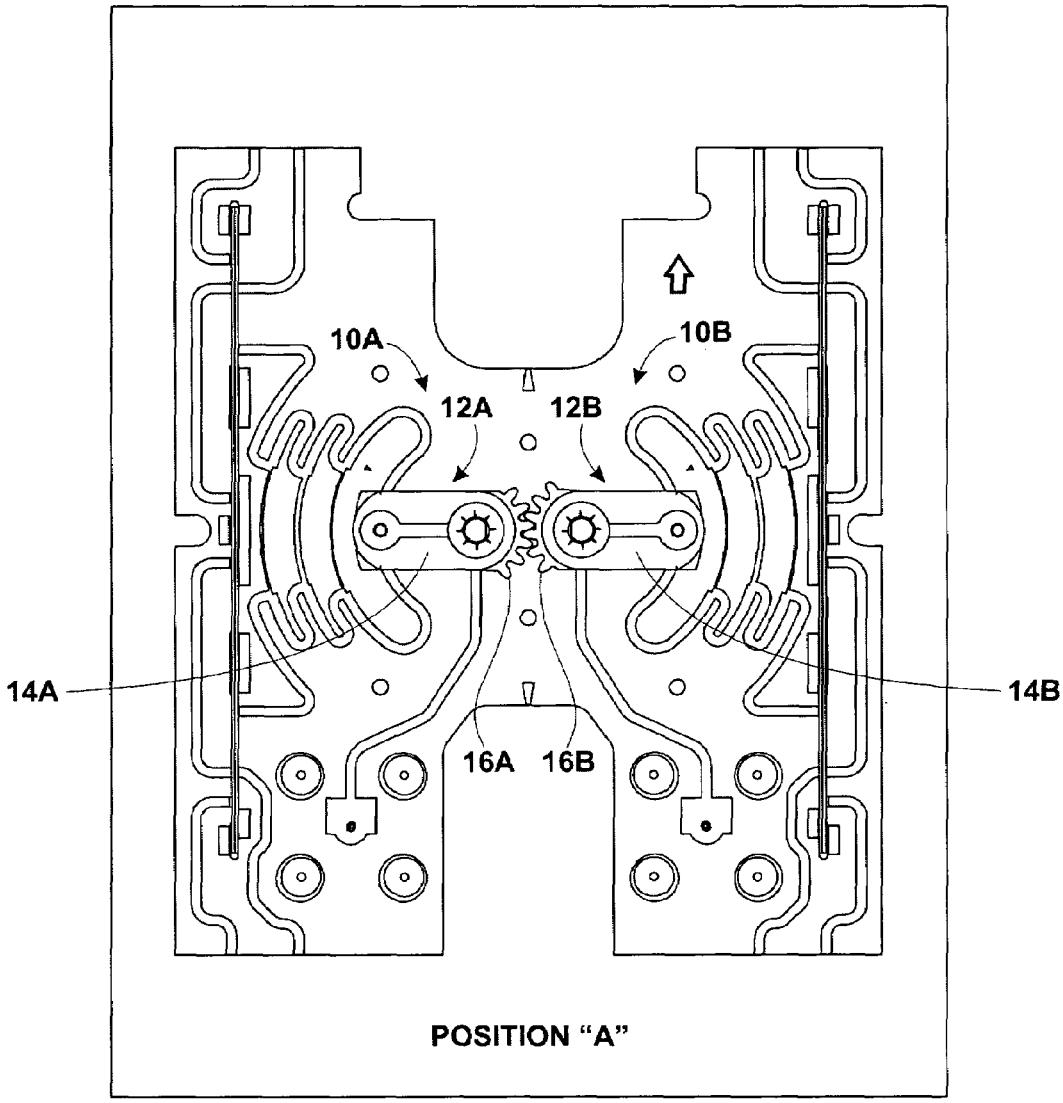
FIG. 2 is a top view of a pair of wiper-type phase shifters with cantilever shoe hold-down mechanisms in a first position.
Figure 3:
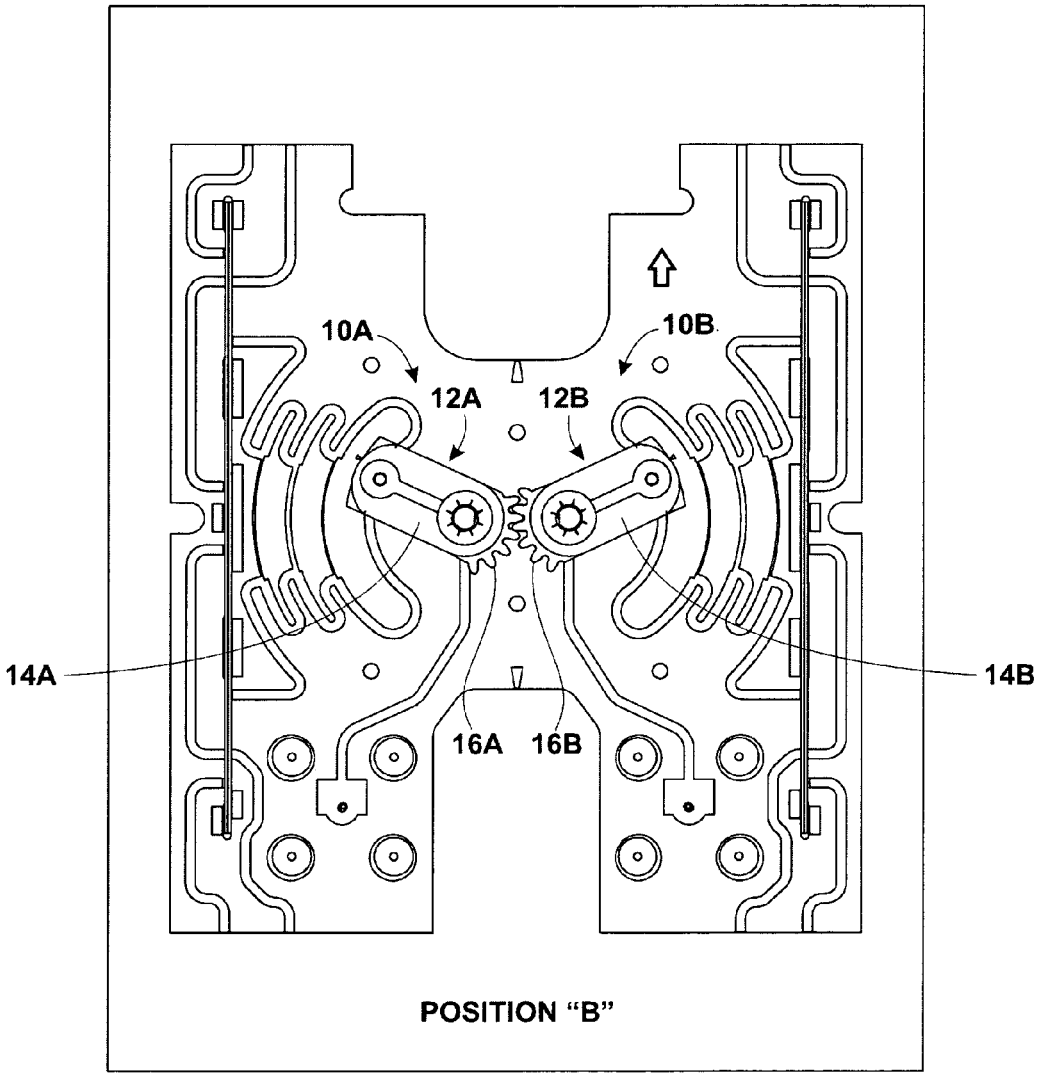
FIG. 3 is a top view of the phase shifters of FIG. 2 in a second position.
Figure 4:
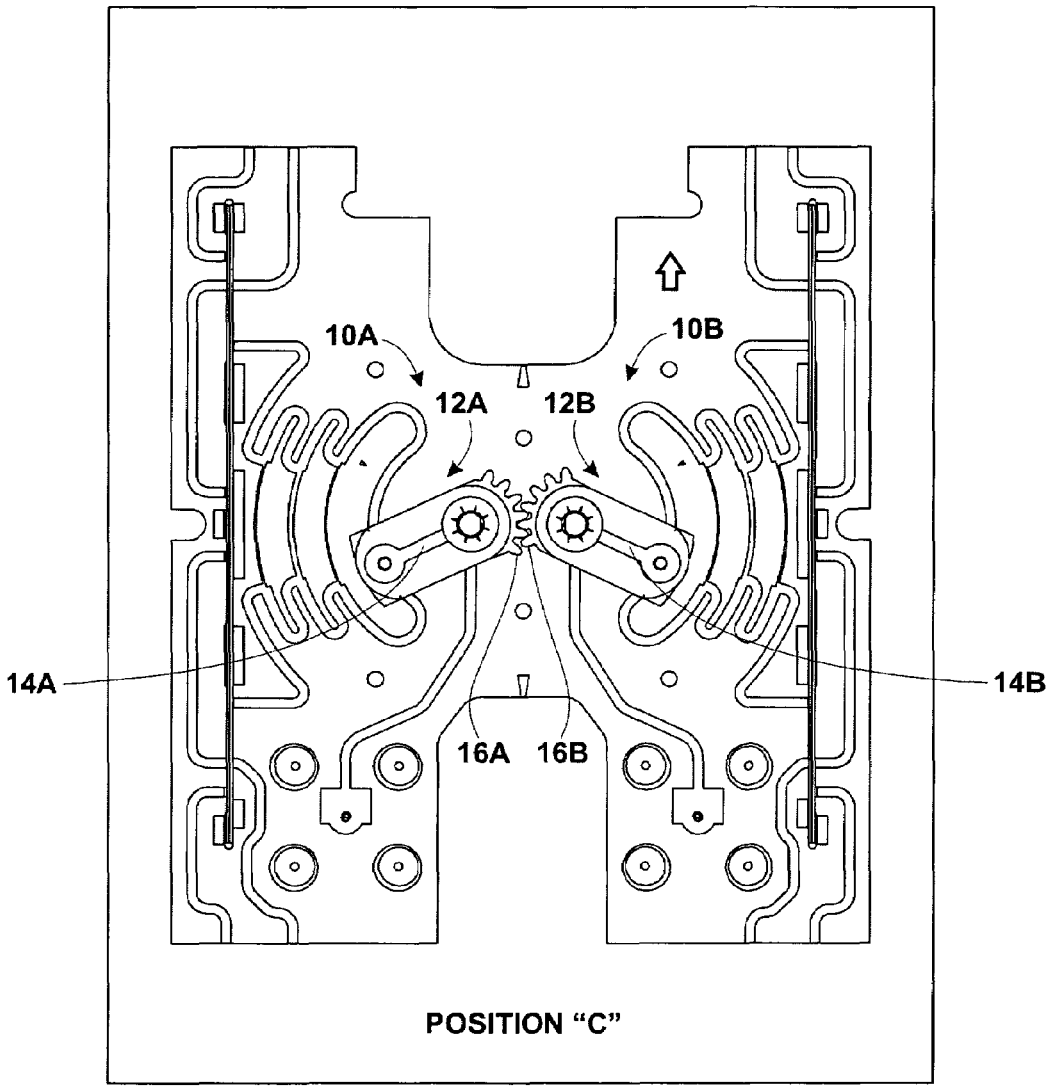
FIG. 4 is a top view of the phase shifters of FIG. 2 in a third position.

FIG. 2 is a top view of a pair of wiper-type phase shifters 10A and 10B with cantilever shoe hold-down mechanisms 12A and 12B, respectively, in a first position "A". This phase shifter avoids the drawback associated with the phase shifter described above through the use of a cantilever shoe wiper hold-down mechanism that ensures that the electrical contact on the wiper arm remains in electrical communication with the transmission trace located on the antenna backplane without relying to an element, such as the spring-loaded set screw 3 shown in FIG. 1, that passes through an opening, such as the slot 1, through the backplane.

The phase shifters 10A and 10B include wiper arms 12A and 12B, respectively, that each have an associated cantilever shoe 14A and 14B, respectively. The wiper arms are formed from small sections of dielectric PC board etched with tin-coated copper traces forming microstrip transmission media segments. The dielectric PC board material may be a PTFE Teflon® laminate, a laminate impregnated with glass fibers, having a relative dielectric constant equal to 2.2 ($\in_r$=2.2). This material can be used to construct PC boards that will exhibit an effective dielectric constant of 1.85 ($\in_{reff}$=1.85) for microstrip transmission media segments exposed to the PC board on one side and exposed to air on the other side and having a characteristic impedance value of 50 Ohms.

Each wiper arm 12A and 12B includes a gear portion, 16A and 16B, respectively, that engage each other. The gear portion may be a spur gear section having an involute tooth design. The tooth geometry in 16A and 16B is symmetric about the local axis of each tooth, each tooth is typically identical in shape, and the gear portion is typically the same for each gear. For this reason, the wiper arms are typically interchangeable with each other, which is desirable from the parts inventory, antenna assembly, and antenna maintenance perspectives. The symmetric gear geometry is advantageous due to the need to drive the wipers bi-directionally. The involute gear geometry can be fabricated using standard PC board milling equipment commonly known as routers. The involute gear has the desirable property that center-to-center distance errors do not translate into angular errors.

Figure 5:
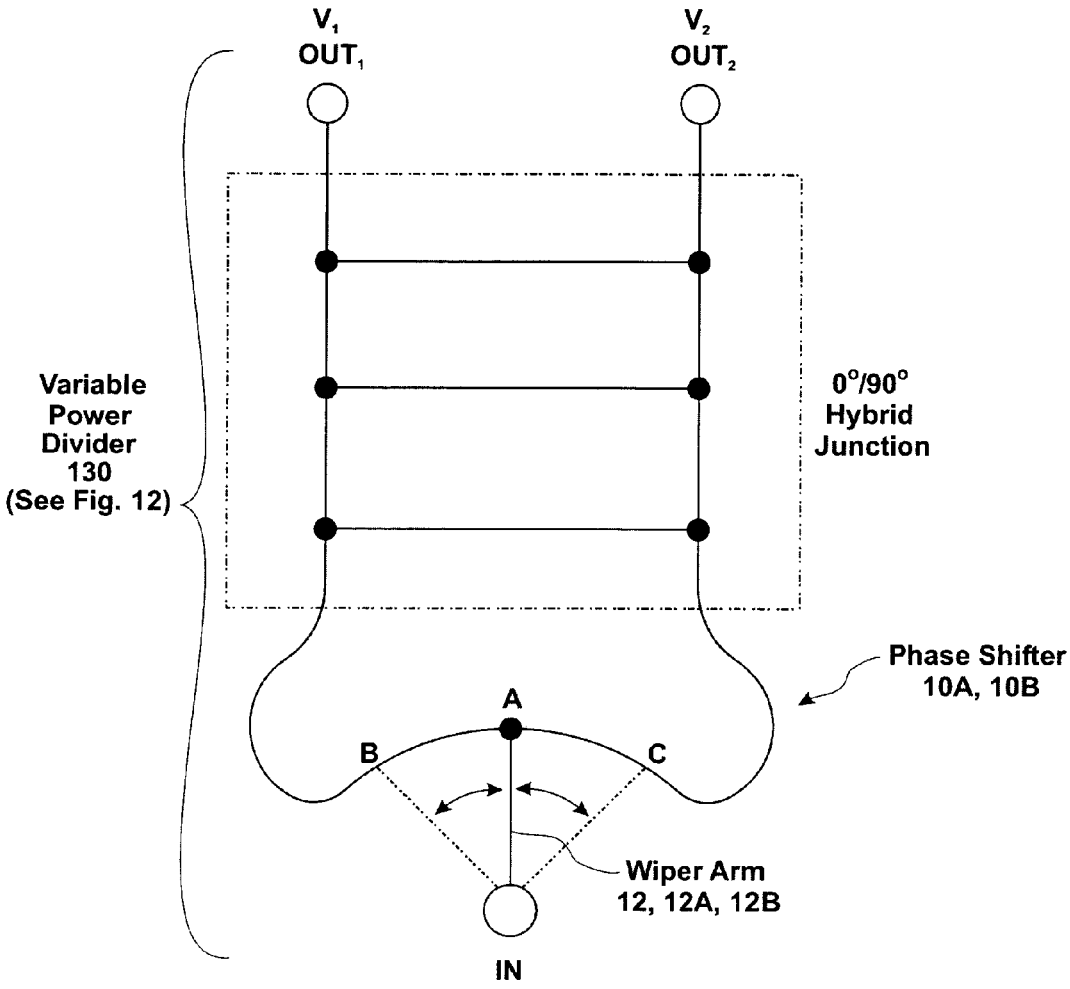
FIG. 5 is a schematic diagram of a wiper-type phase shifter in electrical communication with a hybrid junction circuit to provide a variable power divider.

This respective engagement of the gear portions 16A and 16B allows both wiper arms to be pivoted in a coordinated manner using a common manual or motorized actuator. Referring to FIGS. 2–5, the wiper arms 12A and 12B can be moved continuously through a range of motion from a first sweep extent "B" shown in FIG. 3, through the center point "A" shown in FIG. 2, and to a second sweep extent "C" shown in FIG. 4. FIG. 5 shows this same feature on a schematic diagram. Typically, the center point "A" corresponds to a nominal or zero differential phase shift position, position "B" corresponds to a maximum differential phase shift in one direction (e.g., lagging a reference phase value), and position "C" corresponds to a maximum differential phase in the opposite direction (e.g., leading the a reference phase value). For a beam steering application, the beam direction typically varies in response to changes in the phase shifter setting. In other words, the phase shifter steers the beam. In particular, each phase shifter 10A and 10B may steer a main beam of one polarization of a dual-polarization antenna. Even more particularly, these phase shifters may effect vertical electrical downtilt of the antenna beams corresponding to both polarizations of the dual-polarization antenna in a coordinated manner.

Figure 6:
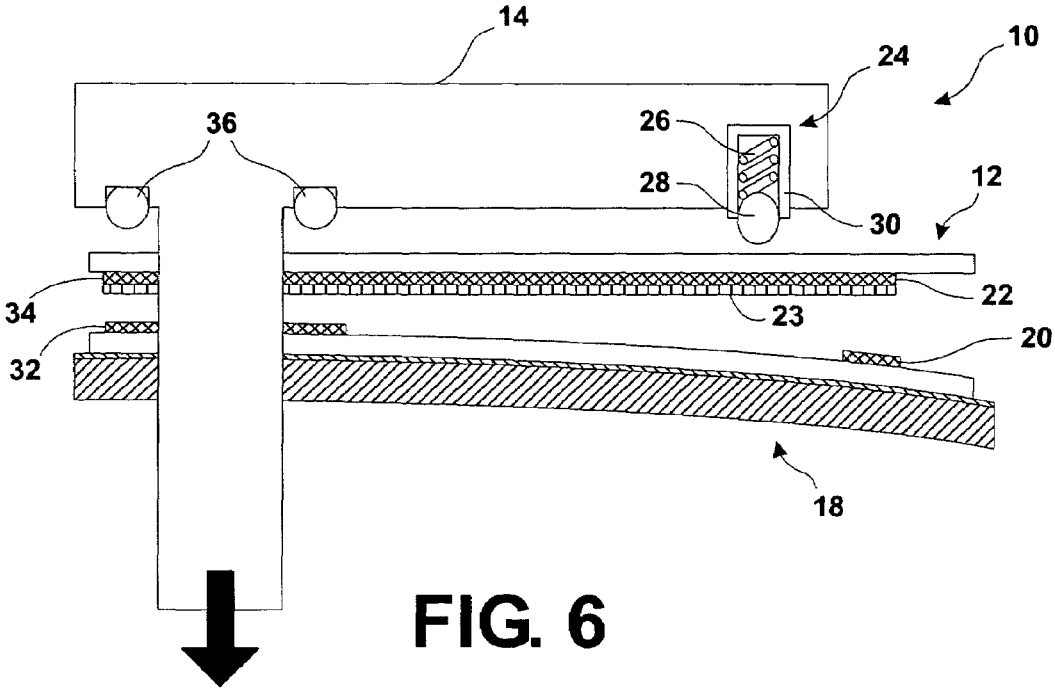
FIG. 6 is a conceptual illustration of the problem of wiper arm separation occurring in a wiper-type phase shifter prior to fully seating the elements.

FIG. 6 is a conceptual illustration of the problem of wiper arm separation occurring in wiper-type phase shifter, which is illustrated for a singly wiper phase shifter designated as phase shifter 10 for descriptive convenience. The phase shifter 10 includes a wiper arm 12 positioned above a backplane 18. Generally, the wiper arm 12 or the backplane 18 may be slightly non-planar at time of manufacture, or they may become so over time due to internal or external forces, such as the weather elements. In FIG. 6, this non-planar configuration is illustrated for conceptual purposes by an exaggerated warp of the backplane. This type of non-planar configuration or effect can cause the transmission media trace 20 carried by the backplane 18 to lose electrical communication with the trace contact 22 carried by the wiper arm 12. To counteract this problem, the cantilever shoe 14 includes a trace contact biasing element 24, in this example a spring-loaded plunger consisting of a spring 26 and ball bearing 28 located inside a cylindrical sleeve 30 that includes a lip sized to retain the ball bearing while allowing it to move reciprocally within the sleeve against the force of the spring.

The backplane 18 also carries a signal conductor 32, in this example a microstrip transmission media circuit. However, it should be understood that other types of signal conductors may carry the signal to the phase shifter, such as a coaxial cable, air microstrip, or any other suitable type of RF signal conductor. To conduct a signal from the signal conductor 32 to the trace contact 22, the wiper arm 12 carries a signal contact 34 positioned above the signal conductor. To ensure that the signal contact 34 remains in electrical communication with the signal conductor 32, the cantilever shoe 14 includes a signal contact biasing element 36, in this example a wave-shaped spring washer. The signal contact 34 and trace contact 22 are typically formed from microstrip and connected to each other with a microstrip trace carried on the wiper arm 12 that can be a dielectric substrate of a PC board.

Figure 7:
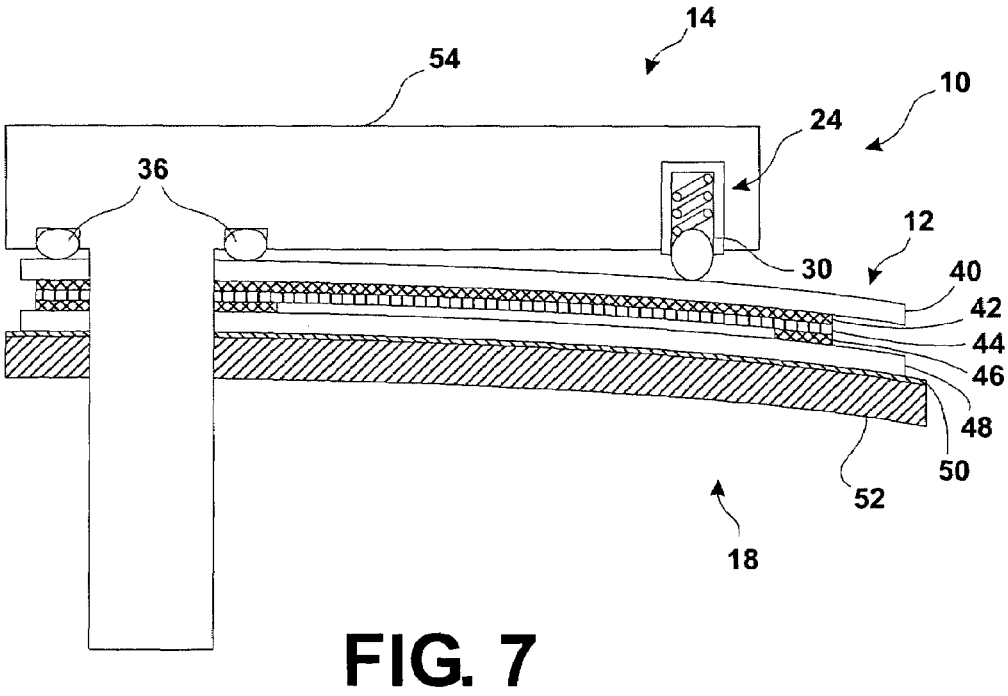
FIG. 7 is a conceptual illustration of a fully seated cantilever shoe to solve the problem of wiper arm separation illustrated in FIG. 6.

As shown in FIG. 7, tightening the cantilever shoe 14 toward the wiper arm 12 brings the biasing elements 24, 36 into contact with the wiper arm, and thereby forces the trace contact 22 toward the transmission media trace 20, and forces the signal contact 34 toward the signal conductor 32. This, in turn, ensures that the transmission media trace 20 remains in electrical communication with the signal conductor 32 while allowing the wiper arm to move pivotally to change the phase setting of the phase shifter 10. It should be noted that the trace contact 22 and the transmission media trace 20 do not contact each other directly, but instead are capacitively coupled through a thin dielectric spacer 23, such as an adhesive backed dielectric tape with a dielectric constant of approximately 3.5 manufactured by Shercon, Inc. of Santa Fe Springs, Calif. The dielectric spacer 23 prevents metal-to-metal contact and thereby reduces the resistance to wiper arm movement. The dielectric tape also avoids wear of the microstrip traces, prevents binding, and prevents the introduction of signal noise into the RF circuit. Likewise, the signal contact 34 and the signal conductor 32 do not contact each other directly, but instead are capacitively coupled through the thin dielectric spacer 23.

Referring to FIG. 7, the constituents of the phase shifter 10 are conveniently shown in cross section. The top layer 40 of the wiper arm 12 is the dielectric PC board substrate formed from glass-impregnated TEFLON® laminate, the next layer 42 is the tin-coated copper microstrip trace, and the next layer 44 is the dielectric spacer material. The next layer 46 is the tin-coated copper microstrip transmission media trace carried on the backplane 18. The next layer 48 is the PC board,substrate of the backplane, which is bonded to an aluminum base plate 52 using a thin dielectric adhesive layer 50, typically the VHB acrylic transfer adhesive by 3M Corporation, of St. Paul, Minn. The body 54 of the cantilever shoe 14A is typically manufactured preferably from a dielectric material and generally a suitable temperature-stable plastic, such as NYLON®, ULTEM® (30% glass-filled polyetherimide) manufactured by General Electric Company, or any other suitable substrate. The trace contact biasing element 24 may be a pin-nosed or a spherical ball-nosed plunger such as a stainless steel "ball push-fit plunger," part number SPFB48, manufactured by Vlier Products, a division of Barry Controls, a part of the Hutchinson Group Company.

Figure 8:
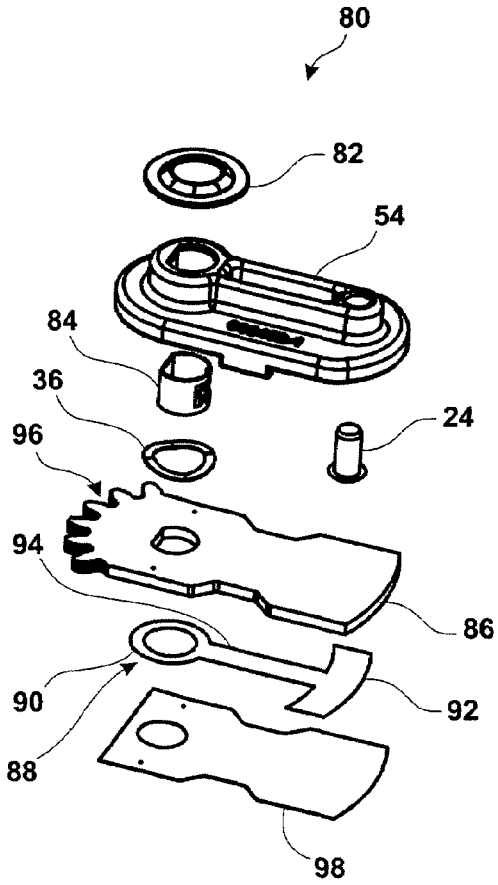
FIG. 8 is an exploded perspective top view of a phase shifter wiper arm with a cantilever shoe.
Figure 9:
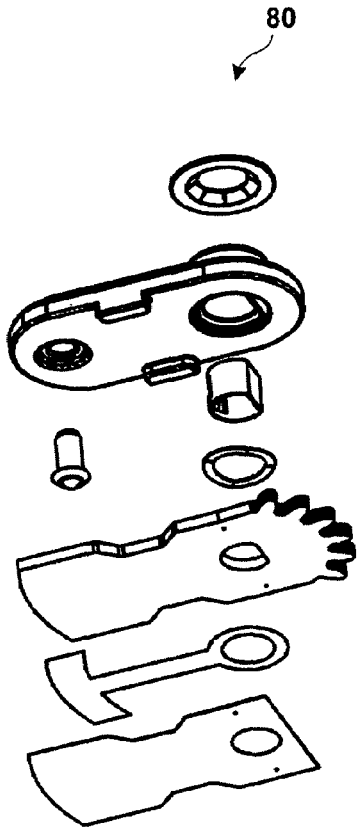
FIG. 9 is an exploded perspective bottom view of the phase shifter wiper arm of FIG. 8.

FIG. 8 is an exploded perspective view of the top of the phase shifter wiper arm assembly 80, and FIG. 9 is a corresponding view of the bottom of the assembly. The assembly includes a push-fit retaining ring 82 for holding the assembly on an actuator shaft. The push-fit retaining ring is located above the cantilever shoe 54, which supports the trace contact biasing element 24, in this, example a ball-nose plunger, and a D-ring sleeve 84 that receives the actuator shaft. The signal contact biasing element 36, in this example a wave-shaped spring washer surrounds the actuator shaft and is sandwiched between the cantilever shoe 54 and the PC board 86 of the wiper arm, which carries a microstrip trace 88 that includes the signal contact 90 and the trace contact 92 connected by a microstrip trace 94. A gear face 96 is cut directly into the PC board 86 of the wiper arm. The microstrip trace 88 is covered by a dielectric spacer layer 98, such as the Shercon tape specified above.

Alternatively, the dielectric spacer layer can be a solder mask type coating found in conventional PC board processing systems, or it can be a thin polyester film known as CPL™ manufactured by Arlon Materials for Electronics a Division of Bairnco Corp. of Orlando Fla. The CPL™ structure can also include the microstrip trace conductors 88 as features defined from a standard PC board etch process.

Figure 10:
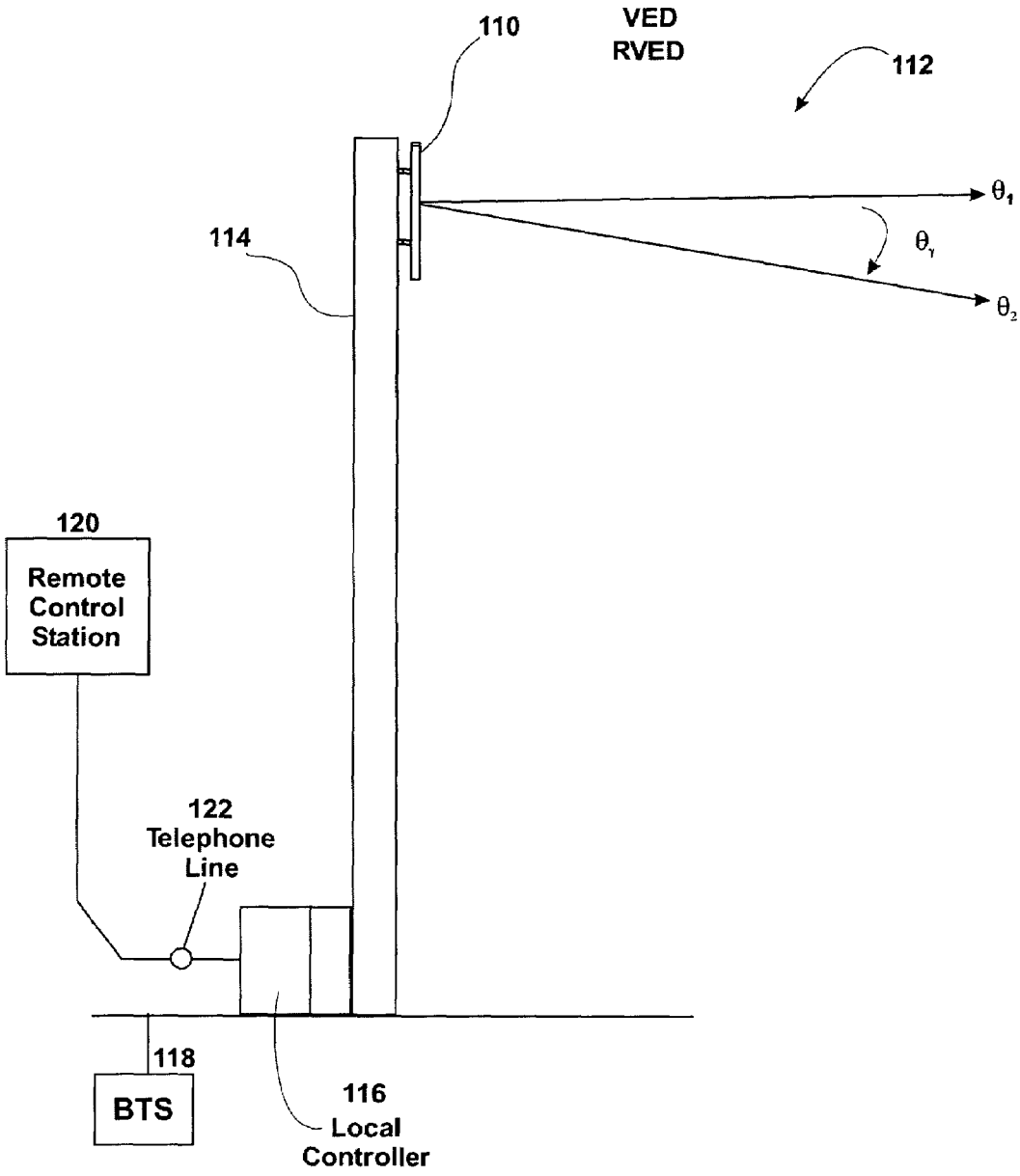
FIG. 10 is a block diagram of a remotely controlled vertical electrical downtilt antenna deployed as a wireless base station antenna.

As shown in FIG. 10, the phase shifters described above may be employed to steer the beam of a remotely- or locally-controlled vertical electrical downtilt antenna 110, which is suitable for use as a wireless base station antenna. This antenna is equipped to perform vertical electrical downtilt of a beam 112 emitted by the antenna. More specifically, the antenna 110, which is typically mounted to a pole 114, tower, building or other suitable support structure, includes an upright panel that supports a number of antenna elements. These antenna elements emit the beam 112 in a boresight direction 115 (shown in FIG. 11), which is the natural propagation direction of the beam when the signals emitted by the antenna elements are in phase. In the particular example shown in FIGS. 10 and 11, the antenna 110 is mounted with its main panel oriented vertically, which generally results in a horizontal boresight direction. This is a typical mounting configuration for a wireless base station antenna.

From the horizontal boresight direction 115, some mechanism is typically provided to direct the beam 112 downward toward the horizon. It is also desirable to have adjustable beam downtilt so that the beam can be pointed toward a desired geographical coverage area where the beam will be received with appropriate strength and to discriminate against the transmission of signals to areas generally beyond the geographical coverage area. The antenna 110 is reciprocal and the properties of the antenna in a reception mode of operation are the same as for a transmission mode at each frequency in the operational band of frequencies. The antenna 110 is configured to implement adjustable beam downtilt within a range $\Theta_r$ that extends between two boundary beam pointing directions, $\Theta_1$ and $\Theta_2$. The tilt range $\Theta_r$ is also typically biased downward from the boresight direction. For example, the upper tilt boundary is typically set toward or just below horizontal, and the tilt range $\Theta_r$ typically extends to about five degrees downward. For example, tilt ranges from one to five degrees from horizontal, and from two to seven degrees from horizontal are typical for antenna arrays having twelve or more radiating elements. However, the selection of the tilt bias and tilt range is a design choice that may be changed from application to application.

Figure 11:
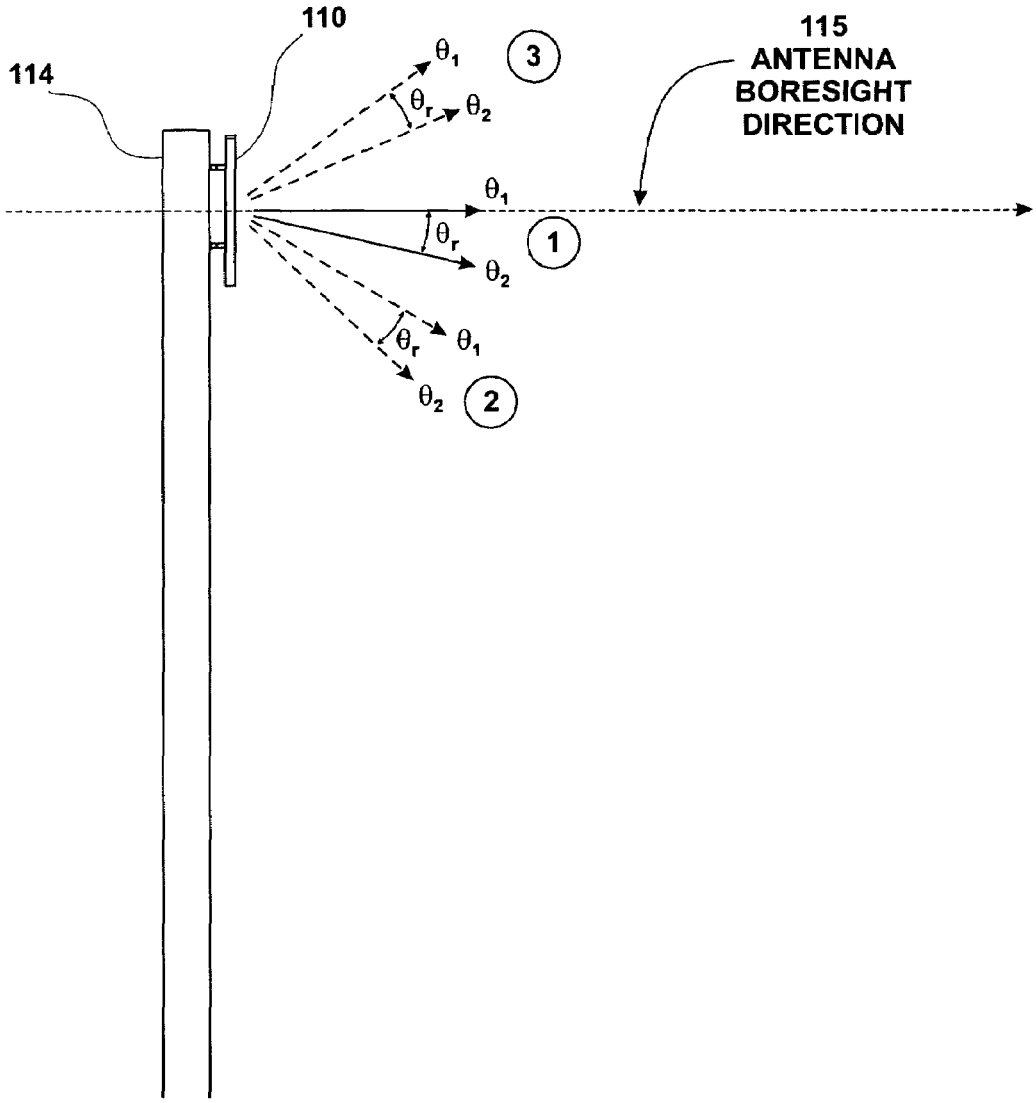
FIG. 11 is a diagram illustrating a vertical electrical downtilt antenna with an adjustable tilt bias.

In addition, the tilt bias may be fixed or adjustable. FIG. 11 illustrates the adjustable tilt bias alternative by showing three tilt bias angles for the antenna 110. For an antenna with an adjustable tilt bias, this parameter may be altered manually or mechanically, and it may be controlled locally or remotely.

Referring again to FIG. 10, the beam tilt bias and the tilt angle within the adjustable tilt range may be controlled is several different ways. For example, one or more control knobs may be located on the antenna 110 itself, typically on the rear of the main panel. However, climbing the pole 114 to adjust the beam tilt may be inconvenient. Therefore, a local controller 116 may be located at a suitable location, such as the base of the pole or with the base transceiver station 118 (BTS). In this case, a motor, such as a servo or stepper motor 136, drives the tilt control in accordance with control signals from the local controller 116. The motor is typically mounted to the rear of the main panel of the antenna 110, but could be located in any other suitable location. In addition, a remote controller 120 may be used to remotely control the beam tilt. For example, the remote controller 120 is typically connected to the local controller 116 by way of a telephone line 122 or other suitable communication system. The local and remote controllers may be any suitable control device, as are well known in the art.

Figure 12:
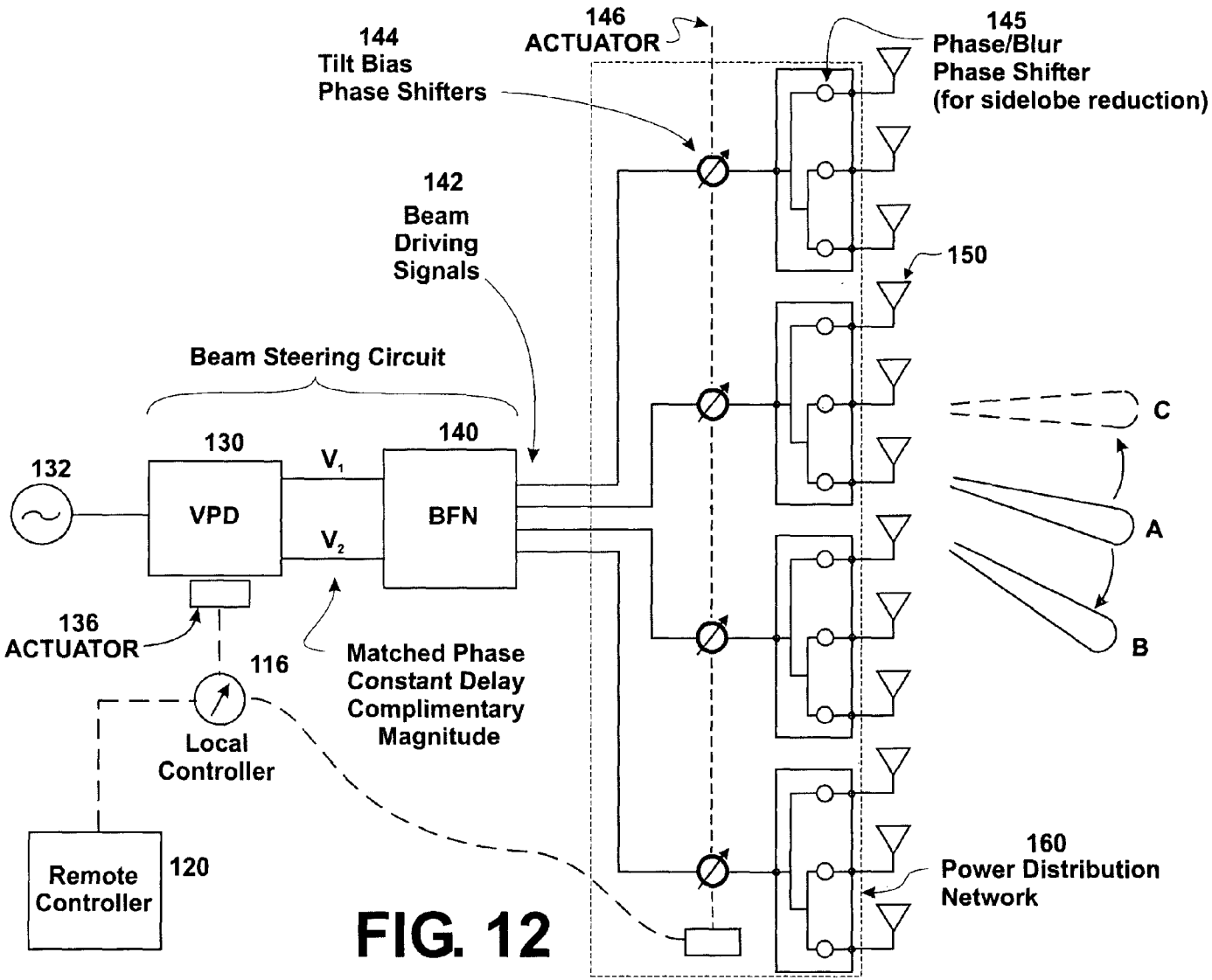
FIG. 12 is a functional block diagram of a vertical electrical downtilt antenna.

FIG. 12 is a functional block diagram of the antenna 110, which includes a beam steering circuit that includes a variable power divider 130, which includes one or more wiper-type phase shifters, and a multi-beam beam forming network 140. The variable power divider 130 divides a voltage signal 132 into two complimentary amplitude voltage drive signals, which provide inputs to the multi-beam beam forming network 140 (BFN). The beam forming network 140, in turn, produces beam driving signals 142 that are transmitted by a power distribution network 160 to a multi-element antenna array 150. The power distribution network 160 divides each beam driving signals as appropriate for delivery to an associated sub-array of the multi-element antenna array 150. The power distribution network 160 also includes tilt bias phase shifters 144 and phase blurring phase shifters 145, which manipulate the phase characteristics of the beam steering signals in a coordinated manner through transmission media trace length adjustment to implement beam tilt and sidelobe reduction.

The variable power divider 130 receives and divides a voltage signal 132 into two voltage drive signals $V_1$ and $V_2$. The voltage signal 132 typically contains encoded mobile communications data and is provided through a coaxial cable that attaches to a connector on the antenna 110, as is well known in the art. FIG. 5 (introduced previously) is a schematic illustration of the variable power divider 130, which is described in greater detail in commonly owned U.S. patent application Ser. No. 10/290,838 entitled "Variable Power Divider" filed on Nov. 8, 2002, which is incorporated herein by reference. The variable power divider 130 uses a single adjustable control element 12A, typically a microstrip wiper arm, to divide the input voltage signal 132 into the voltage drive signals $V_1$ and $V_2$, which have complimentary amplitude and substantially constant phase delay over the range of voltage amplitude division.

More specifically, the amplitudes of sum of $V_1$ and $V_2$ sum to the amplitude input voltage signal 132, and vary inversely with each other as the power is divided between them. In particular, the power division ranges from 100% to $V_1$ and zero to $V_2$ when the adjustable control element 12A is in the position labeled "C" on FIG. 5 to zero to $V_1$ and 100% to $V_2$ when the adjustable control element 12A is in the position labeled "B" on FIG. 5. In addition, the power division varies smoothly between these two extremes as the adjustable control element 12A is moved between the positions "B" and "C" with position "A" representing the 50% division point.

In addition to having complimentary amplitude, the voltage drive signals $V_1$ and $V_2$ exhibit matched phase (i.e., they continuously have substantially the same phase) and substantially constant phase delay through the variable power divider 130. In other words, the phase characteristics of the voltage drive signals $V_1$ and $V_2$ with respect to each other, and with respect to the input voltage signal 132, remains substantially constant as the power division varies through the range of power division. An actuator 136, such as a control knob or motor, is used to move the adjustable control element 12A, which in turn causes adjustment of the beam tilt. This is illustrated in FIGS. 5 and 12, in which the beam tilt position labeled "A" in FIG. 12 corresponds to the position "A" of the adjustable control element 12A shown in FIG. 5; the beam tilt position labeled "B" in FIG. 12 corresponds to the position "B" of the adjustable control element 12A shown in FIG. 5; and the beam tilt position labeled "C" in FIG. 12 corresponds to the position "C" of the adjustable control element 12A shown in FIG. 5.

Referring to FIG. 12, the voltage drive signals $V_1$ and $V_2$ provide input signals to the multi-beam beam forming network 140, which is typically configured as an orthogonal two-by-four beam forming network or a four-by-four Butler matrix with two of the input ports shunted to ground through impedance matching resistors. Both configurations, along with a number of other signal processing modules, are described in detail in commonly owned U.S. patent application Ser. No. 10/623,382 entitled "Double-Sided, Edge-Mounted Stripline Signal Processing Modules And Modular Network" filed on Jul. 18, 2003, which is incorporated herein by reference. Although the beam forming network 140 need not be configured as a double-sided, edge-mounted module, this configuration results in many advantages.

It should be appreciated that the number of outputs of the beam forming network 140 typically corresponds to the number of antenna sub-arrays, and may therefore be altered in accordance with the needs of a particular application. Although antennas with four and eight sub-arrays are common, other configurations, such as three, five and six sub-arrays are also typical. Of course, any desired number of sub-arrays and a wide variety of beam forming networks may be accommodated.

FIGS. 13–16 are computer-aided design (CAD) to-scale illustrations of a particular commercial embodiment of the vertical electrical downtilt antenna 180, which includes twelve dual-polarization antenna elements 182. This antenna is designed for an operational carrier frequency of 1.92 GHz (which is the center frequency of the authorized US Personal Communication Services, PCS, wireless band), and the antenna elements are spaced 0.7 free-space wavelength apart, which is approximately 4.6 inches. The electrically conducting backplane 184 for this antenna is rectangular with dimensions 56 inches long by 8 inch wide [approximately 142 cm by 20 cm]. A sixteen-element antenna is correspondingly longer, 72 inches long by 8 inches wide [approximately 183 cm by 20 cm] to accommodate four additional antenna elements with the same spacing. The radome 186 fits over and attaches to the backplane.

The antenna 180 includes two mounting brackets 188A–B, two coaxial cable antenna interface connectors 190A–B, and an actuator knob assembly 192 connect to the rear side of the backplane 184. The coaxial cable connectors 190A–B receive coaxial cables supplying two input voltage signals 132 (shown on FIG. 12), one for each polarization of the dual-polarization antenna. A conducting ground plane on the underside of a main panel 196 is attached with a non-conducting adhesive 194 to the front side of the backplane 184. The conducting ground plane of the main panel printed circuit (PC) board 196 is capacitively coupled to the backplane 184 for RF signal flow across the junction. The main panel 196 is a dielectric PC board etched with tin-coated copper traces that form transmission media segments carrying the voltage signals from the coaxial cables connectors 190A–B to the antenna elements 182. More specifically, the transmission media segments form two virtually identical beam steering and power distribution circuits 198A–B, one for each polarization. The dielectric material of the main panel 196 may be PTFE Teflon®, as described previously.

Figure 13:
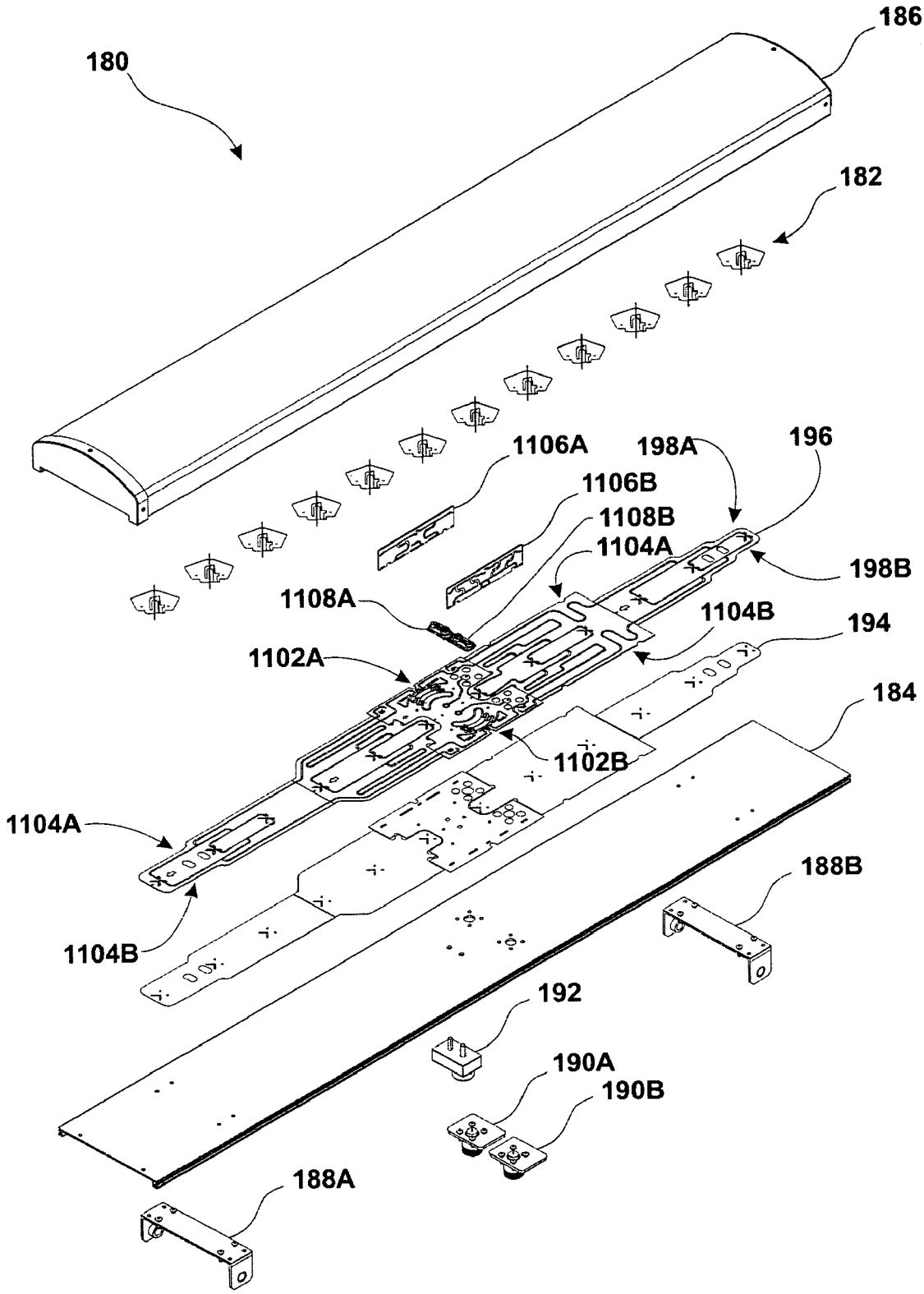
FIG. 13 is an exploded perspective view of a dual-polarization vertical electrical downtilt antenna including a pair of commonly driven wiper-type phase shifters with cantilever shoe wiper arm hold-down mechanisms.

Referring to FIGS. 5, 12 and 13, two variable power dividers 1102A–B (one for each polarization—element 130 on FIG. 12) and two power distribution networks 1104A–B (one for each polarization—element 160 on FIG. 13) are located on the main panel 196, whereas two beam forming networks 1106A–B (one for each polarization—element 140 on FIG. 3) are implemented as double-sided, edge-mounted modules that are solder-connected to the main panel 196. Two wiper arms 1108A–B (one for each polarization—element 12A on FIG. 5) are pivotally attached to the variable power divider areas of the main panel 196. The wiper arms 1108A–B are formed on small dielectric PC boards with etched copper traces similar to the materials used to construct main panel (but without a ground plane), and are mechanically coupled to each other through dove-tail gears formed into rear portions of the wiper arms. This allows both wiper arms to be moved in a coordinated manner by the single actuator knob 192 (element 136 on FIG. 12). In motorized embodiments, the actuator knob assembly 192 is replaced by a small motor and mechanical drive, such as a servo or stepper motor, mounted to rear of the backplane 184. The motor may be housed in a suitable enclosure and typically includes an associated electronics PC board assembly for electrical power and motor control.

In addition, for embodiments including variable tilt bias, a rack and pinion drive system with a separate motor is typically attached to the rear side of the backplane 184. In specific embodiments, the tilt bias phase shifters may be implemented as gear-driven, trombone-type or wiper-type phase shifters, which are typically distributed in two rows (one for each polarization) along the main panel 196. In addition, a single toothed rack moved by a single knob or motor driven gear can be used to turn all of the tilt bias phase shifters in a coordinated manner so that all of the antenna elements for both polarizations are tilt biased in a coordinated manner.

Figure 14:
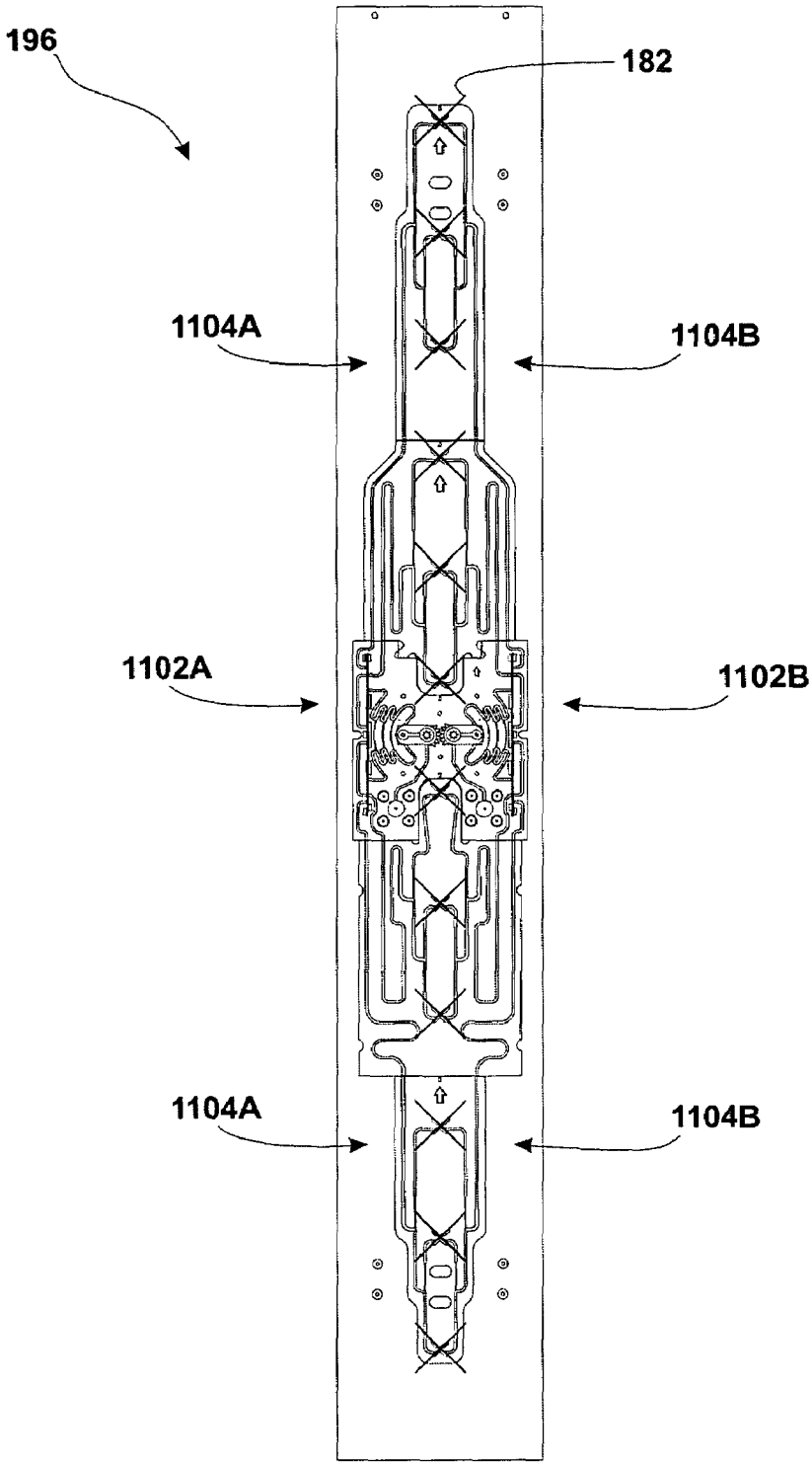
FIG. 14 is a front view of a main panel for a vertical electrical downtilt antenna.

FIG. 14 is a front view of the main panel 196. One of the antenna elements 182 is labeled for reference. The variable power dividers 1102A–B and the power distribution networks 1104A–B are shown a bit more clearly in this view. The wiper arms 1108A–B are shown in the center of the main panel 196 but have not been labeled to avoid obscuring the figure. The beam forming modules 1106A–B are difficult to see in this view because they are edge mounted to the main panel 196.

Figure 15:
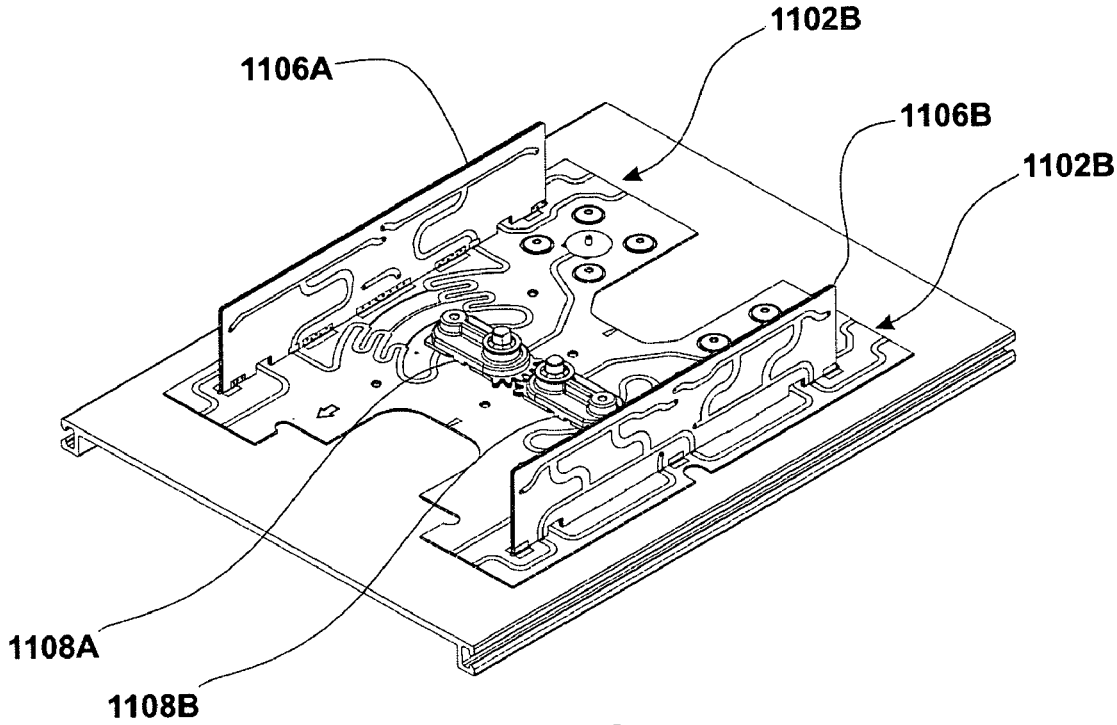
FIG. 15 is a perspective view of the front of a beam steering circuit attached to a section of an antenna backplane.
Figure 16:
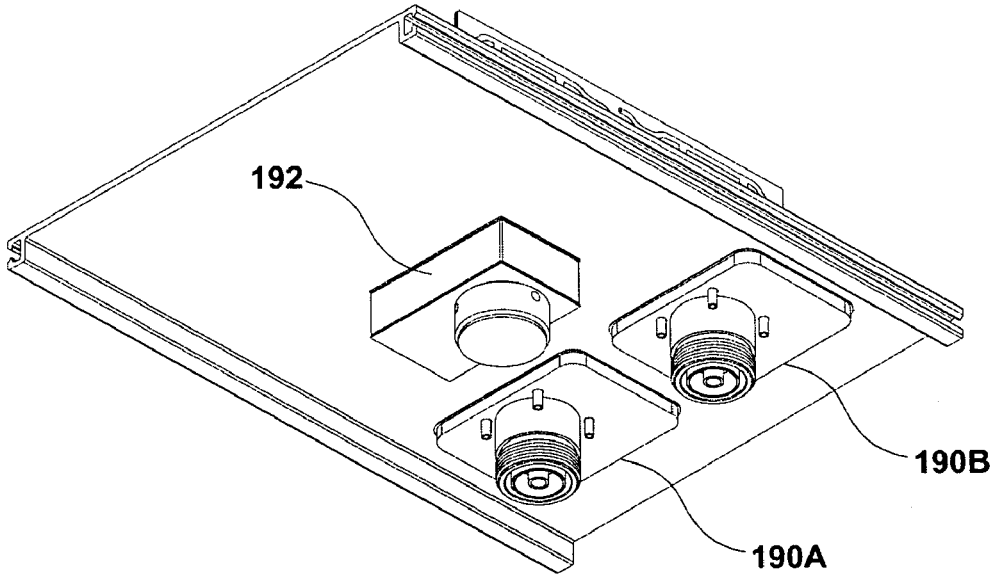
FIG. 16 is a perspective view of the back of the beam steering circuit of FIG. 15.

FIG. 15 is a perspective view of the top side of the section of the antenna carrying the beam steering circuit, which includes the variable power dividers 1102A–B and the beam forming modules 1106A–B. This illustration provides a better view of the beam forming modules 1106A–B and the wiper arms 1108A–B. FIG. 16 is a perspective view of the bottom side of this same section of the antenna, which shows the cable connectors 190A–B and the control actuator 192.

Figure 17:
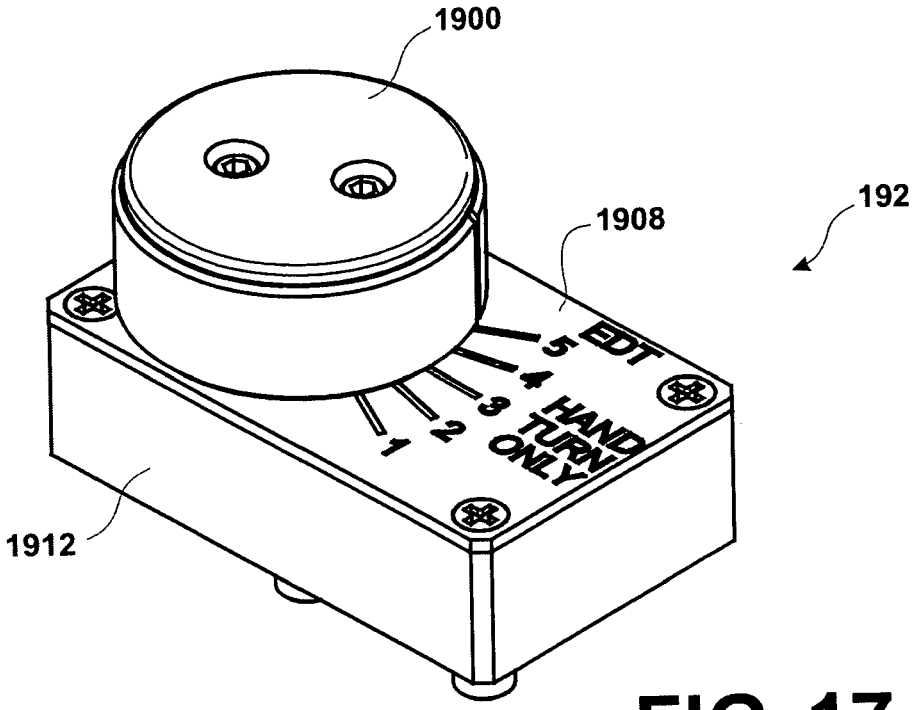
FIG. 17 is a perspective view of the top of a manual actuator for operating a wiper-type phase shifter.
Figure 18:
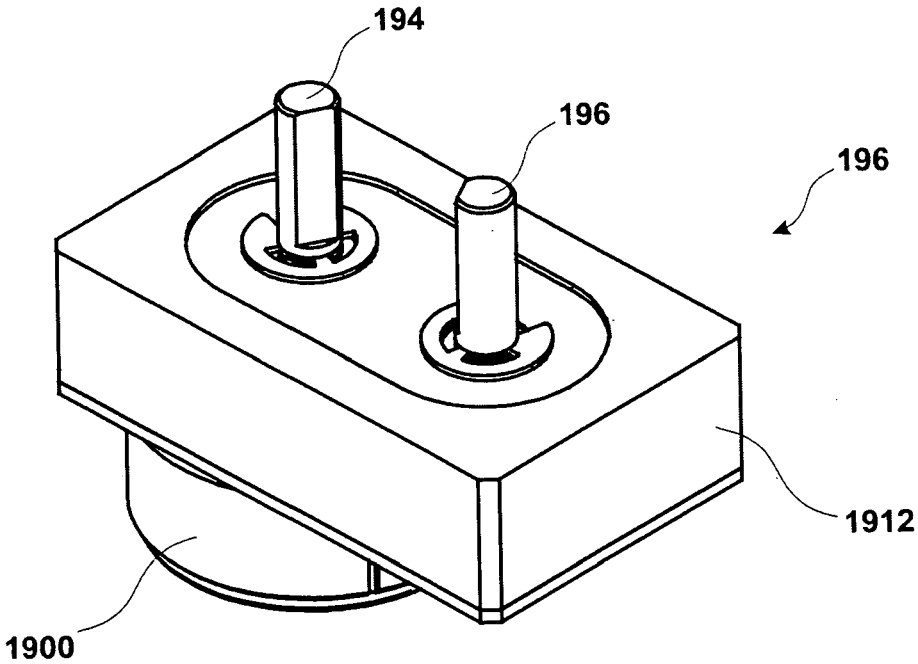
FIG. 18 is a perspective view of the bottom of the manual actuator of FIG. 17.
Figure 19:
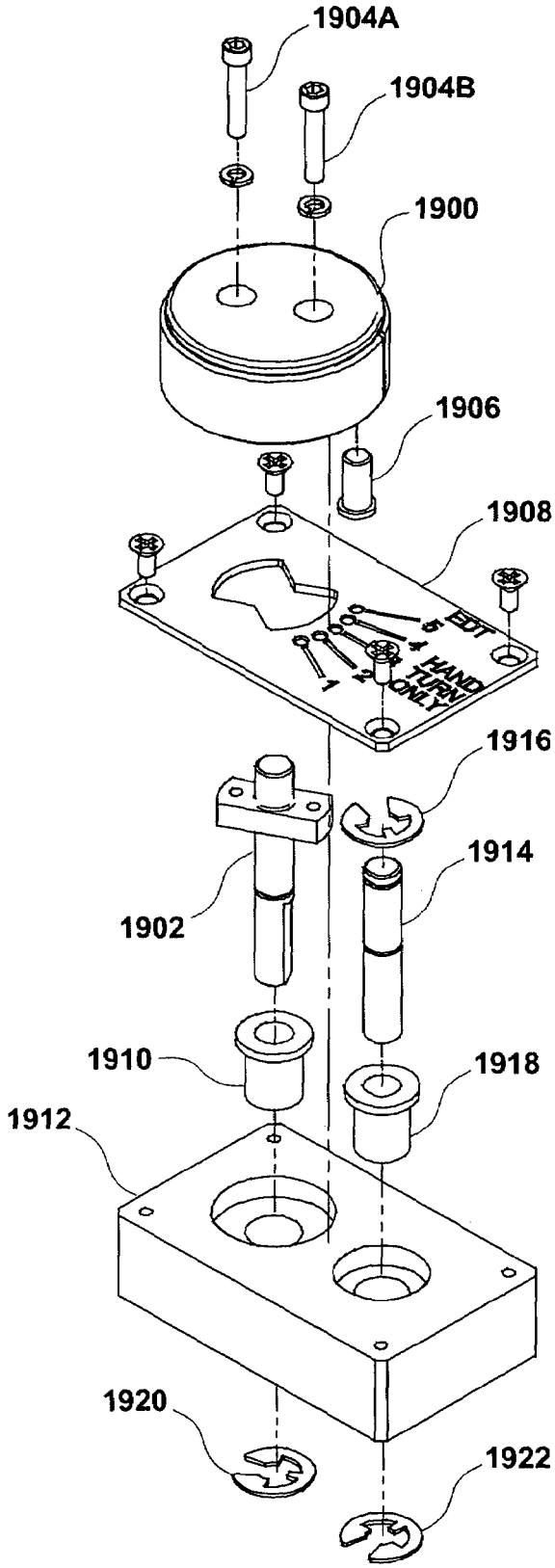
FIG. 19 is an exploded perspective view of the manual actuator of FIG. 17.

FIG. 17 is a perspective view of the top of a manual actuator 192, and FIG. 18 is a perspective view of the bottom of the manual actuator showing the actuator shaft 194 which fits into the actuator arm sleeve 84 shown on FIGS. 8 and 9. A second non-actuated shaft 196 is also provided for mounting stability. FIG. 19 is an exploded perspective view of the manual actuator 192, which includes a control knob 1900 connected to a drive shaft 1902 by two bolts 1904A–B. The knob 1900 carries a ball-nose spring-loaded plunger 1906 that acts as a detent mechanism that removably fits into positioning holes on a face plate 1908. The drive shaft 1902 fits through a flange bearing 1910 and into a housing 1912. An optional non-driven shaft 1914 positioned parallel to the drive shaft 1902 extends from the underside of the face plate 1908 through a second flange bearing 1918 and into the housing 1912. The non-driven shaft 1914 is held in place by an e-ring 1916 on the top side of the housing 1912. E-rings 1920 and 1922 secure the drive shaft 1902 and the non-driven shaft 1914, respectively, on the underside of the housing 1912.

Figure 20:
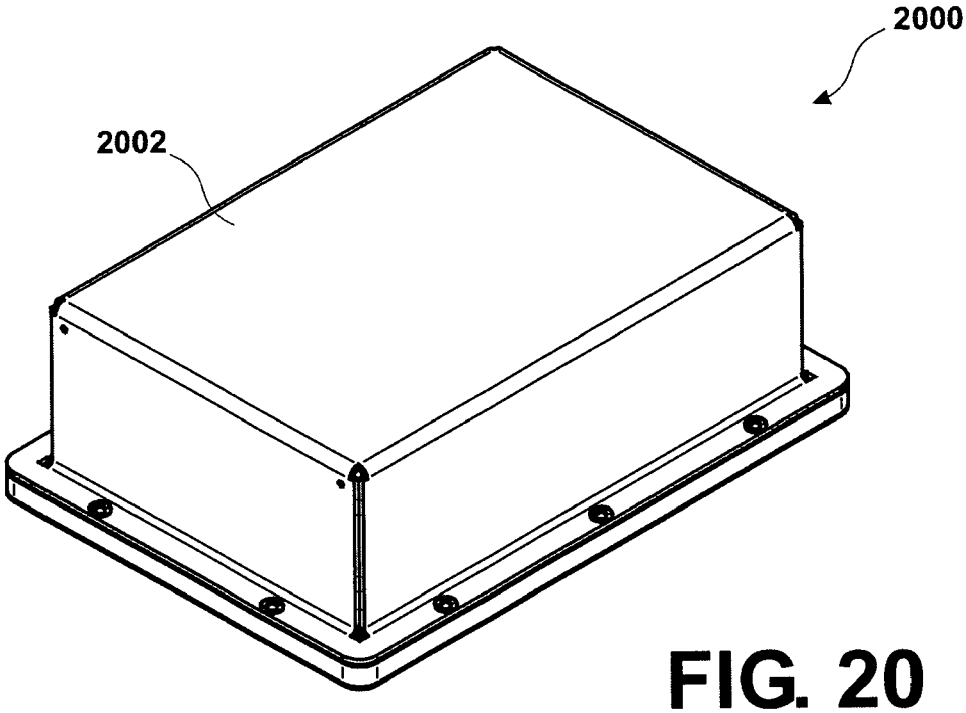
FIG. 20 is a perspective view of the top of a motorized actuator for operating a wiper-type phase shifter.
Figure 21:
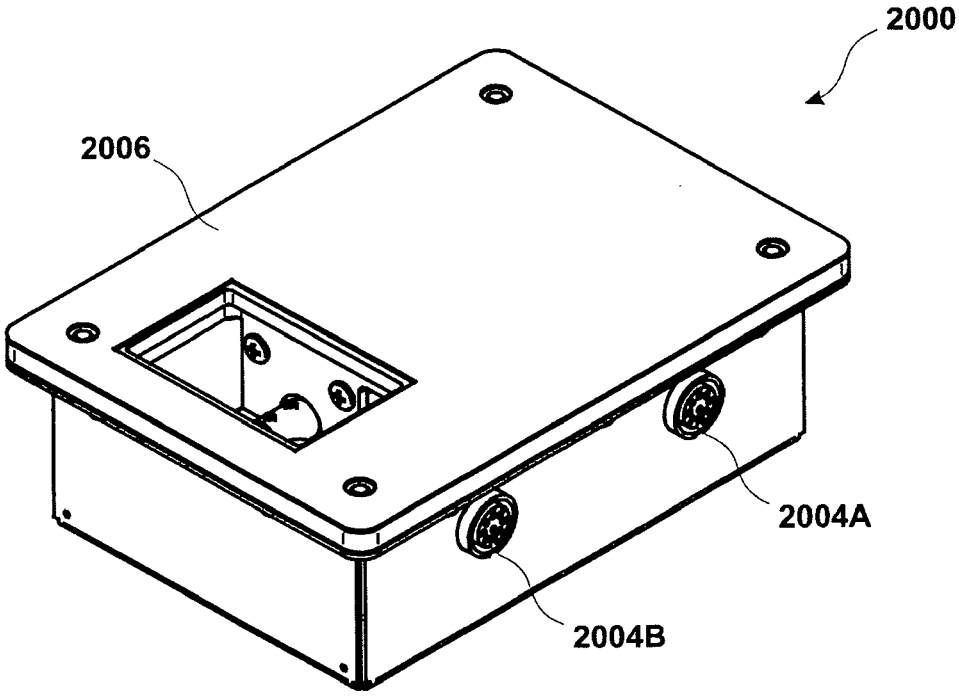
FIG. 21 is a perspective view of the bottom of the motorized actuator of FIG. 20.
Figure 22:
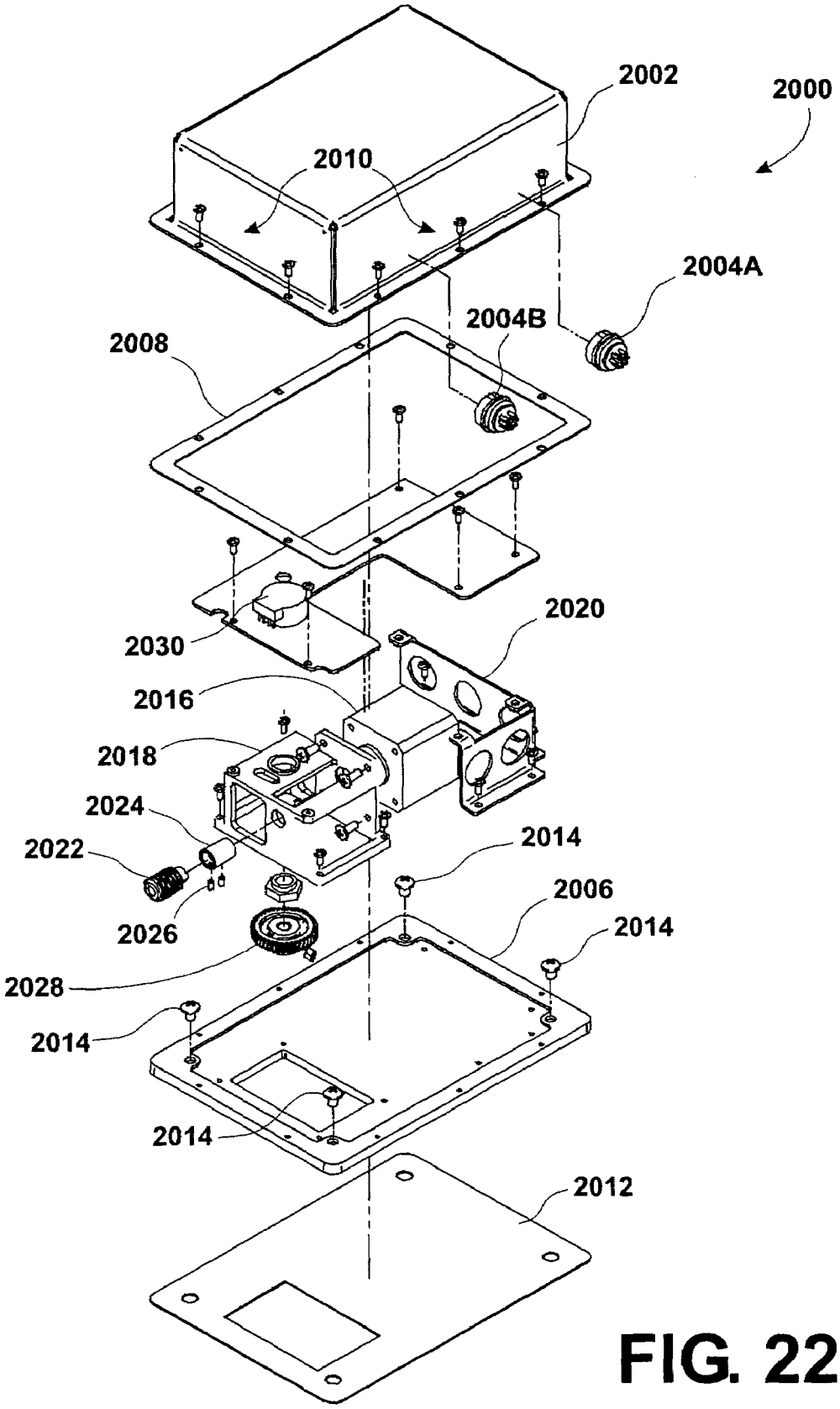
FIG. 22 is an exploded perspective view of the motorized actuator of FIG. 20.

FIG. 20 is a perspective view of the top side of a motorized actuator 2000 for operating a wiper-type phase shifter, and FIG. 21 is a perspective view of the bottom side of the motorized actuator. FIG. 22 is an exploded perspective view of the motorized actuator, which is a motor-driven rotational actuator that mounts on the rear of the backplane in the same location as the manual actuator 192, typically on the backplane opposite the beam forming circuit as shown in FIGS. 15–16. The motorized actuator 2000 includes a housing 2002 that supports cable connectors 2004A–B and provides protection of the internal components from weather and debris. The housing 2002 is secured to a mounting plate 2006 through a gasket 2008 by a number of screws 2010 to form an enclosure. The mounting plate 2006, in turn, is secured to the antenna backplane through a gasket 2012 by a number of screws 2014. The enclosure houses a stepper motor 2016 supported by a pair of brackets 2018, 2020.

In particular, the stepper motor may be a 1.8 degree stepper motor operating at 12 Volts, 0.4 Amperes, such as model no. SST42D manufactured by Shiano Kenshi Co. Ltd. The stepper motor 2016 is controlled by a custom designed and manufactured electronic control board (not shown) that is supported by the bracket 2018. The motor drives a worm gear 2022 that is affixed to the output shaft of the motor by a sleeve 2024 and a set screw 2026. The worm gear, in turn, drives a spur gear 2028 that drives an actuator shaft that fits into the actuator arm sleeve 84 of the wiper arm, as shown on FIGS. 8 and 9. A potentiometer 2030 tracks the position of the stepper motor.

In view of the foregoing, it will be appreciated that present invention provides significant improvements for implementing wiper-type phase shifters for wireless base station antennas including dual-polarization antennas. It should be understood that the foregoing relates only to the exemplary embodiments of the present invention, and that numerous changes may be made therein without departing from the spirit and scope of the invention as defined by the following claims.

The invention claimed is:

1. A phase shifter, comprising:

a backplane carrying a transmission media trace;

a wiper arm pivotally attached to the backplane and carrying a trace contact that is in electrical communication with the transmission media trace;

an actuator for pivoting the wiper arm with respect to the backplane to move the trace contact along the transmission media trace while maintaining electrical communication between the trace contact and the transmission media trace;

a signal conductor in electrical communication with the trace contact; and a cantilever shoe including a trace contact biasing element configured to bias the trace contact toward the transmission media trace while the trace contact moves along the transmission media trace.

2. The phase shifter of claim 1, wherein the trace contact biasing element comprises a spring-loaded plunger positioned adjacent to the trace contact.

3. The phase shifter of claim 1, wherein:

the signal conductor comprises a signal trace carried on the backplane;

the wiper arm comprises a signal contact electrically located between the signal conductor and the trace contact; and the cantilever shoe comprises a signal contact biasing element configured to bias the signal contact toward the signal trace.

4. The phase shifter of claim 1, wherein the signal contact biasing element comprises a spring washer positioned adjacent to the signal contact.

5. The phase shifter of claim 1, wherein the actuator comprises a knob for manually pivoting the wiper arm.

6. The phase shifter of claim 1, wherein the actuator comprises a motor for mechanically pivoting the wiper arm.

7. The phase shifter of claim 6, wherein the wiper arm is located on a front side of the backplane and the motor is located on a rear side of the backplane.

8. The phase shifter of claim 6, further comprising a controller for remotely controlling the motor.

9. The phase shifter of claim 6, wherein the wiper arm is located on a front side of the backplane and the actuator is located on a rear side of the backplane.

10. The phase shifter of claim 6, further comprising a controller for remotely controlling the actuator.

11. The phase shifter of claim 1, wherein the wiper arm defines a gear section for coordinating movement of the wiper arm with another element.

12. The phase shifter of claim 11, in combination with a second similar phase shifter, wherein the gear sections of the wiper arms engage each other to cause coordinated pivotal movement of the wiper arms.

13. The phase shifter of claim 12, wherein each phase shifter drives a polarization circuit of a dual-polarization antenna.

14. The phase shifter of claim 12, wherein each phase shifter drives a polarization circuit of a dual-polarization antenna.

15. The phase shifter of claim 11, in combination with a second similar phase shifter, wherein the gear sections of the wiper arms engage each other to cause coordinated pivotal movement of the wiper arms.

16. The phase shifter of claim 1, wherein the trace contact biasing element comprises a spring-loaded plunger positioned adjacent to the trace contact.

17. The phase shifter of claim 1, wherein:

the signal conductor comprises a signal trace carried on the backplane;

the wiper arm comprises a signal contact electrically located between the signal conductor and the trace contact; and the cantilever shoe comprises a signal contact biasing element configured to bias the signal contact toward the signal trace.

18. The phase shifter of claim 1, wherein the signal contact biasing element comprises a spring washer positioned adjacent to the signal contact.

19. The phase shifter of claim 1, wherein the wiper arm defines a gear section for coordinating movement of the wiper arm with another element.

20. A phase shifter, comprising:

a backplane carrying a transmission media trace;

a wiper arm pivotally attached to the backplane and carrying a trace contact;

an actuator for pivoting the wiper arm with respect to the backplane to move the trace contact along the backplane and in electrical communication with the transmission media trace;

a signal conductor in electrical communication with the trace contact; and a cantilever shoe including a trace contact biasing element configured to bias the trace contact toward the backplane while the trace contact moves along the backplane.

* * * * *